US009587558B2

(12) United States Patent
Vengen

(10) Patent No.: US 9,587,558 B2
(45) Date of Patent: Mar. 7, 2017

(54) INTERNAL COMBUSTION ENGINE

(71) Applicant: Joseph Vengen, Oak Ridge, NJ (US)

(72) Inventor: Joseph Vengen, Oak Ridge, NJ (US)

(73) Assignee: Vengen Technologies LLC, Oak Ridge, NJ (US)

( * ) Notice: Subject to any disclaimer, the term of this patent is extended or adjusted under 35 U.S.C. 154(b) by 774 days.

(21) Appl. No.: 14/088,424

(22) Filed: Nov. 24, 2013

(65) Prior Publication Data

US 2015/0144103 A1 May 28, 2015

(51) Int. Cl.
*F02B 59/00* (2006.01)

(52) U.S. Cl.
CPC ..... *F02B 59/00* (2013.01)

(58) Field of Classification Search
CPC ..... F02B 59/00; F02B 57/08
USPC ..... 123/223, 224, 226, 43 R; 418/176, 261, 418/262, 263, 265, 268
See application file for complete search history.

(56) References Cited

U.S. PATENT DOCUMENTS

| | | | | |
|---|---|---|---|---|
| 2,049,780 | A | 8/1936 | Rustemeyer | |
| 2,242,231 | A | 5/1941 | Cantoni | |
| 2,280,669 | A | 4/1942 | Sklenar | |
| 3,739,756 | A | 6/1973 | Villella | |
| 3,991,728 | A | 11/1976 | Vittert | |
| 4,010,719 | A | 3/1977 | Lappa | |
| 4,030,471 | A * | 6/1977 | Ginkel | F01B 1/0613 123/197.1 |
| 4,077,365 | A * | 3/1978 | Schlueter | F01B 13/045 123/43 R |
| 4,078,529 | A | 3/1978 | Warwick | |
| 4,136,646 | A | 1/1979 | Lappa | |
| 4,838,214 | A * | 6/1989 | Barrett | F02B 75/243 123/318 |
| 5,682,843 | A | 11/1997 | Clifford | |
| 5,720,241 | A | 2/1998 | Gail | |
| 6,457,443 | B1 | 10/2002 | Lillbacka | |
| 6,591,791 | B2 | 7/2003 | De Bei | |
| 6,615,793 | B1 * | 9/2003 | Usack | F02B 53/04 123/242 |
| 6,883,473 | B2 | 4/2005 | Wondergem | |
| 6,895,906 | B1 | 5/2005 | Gahan | |
| 8,240,147 | B2 | 8/2012 | Taba | |
| 2003/0127062 | A1 | 7/2003 | Ahn | |

(Continued)

FOREIGN PATENT DOCUMENTS

GB 1006303 A * 9/1965 ..... F02B 53/00

*Primary Examiner* — Patrick Maines
(74) *Attorney, Agent, or Firm* — John M. Hammond; Patent Innovations LLC

(57) ABSTRACT

An internal combustion engine comprising an engine block comprised of a main cavity, an intake plenum, and an exhaust plenum; a crankshaft supported within the main cavity of the engine block; a rotating piston assembly contained within the main cavity of the engine block and comprised of a rotatable cylinder housing having a housing axis of rotation and comprised of a plurality of pistons contained in combustion cylinders; and a rotating valve ring contained within the engine block and surrounding the rotating piston assembly, and comprised of intake ports, ignition energy ports, and exhaust ports corresponding to each of the plurality of combustion cylinders. The rotatable cylinder housing has an axis of rotation that is parallel to and offset from the crankshaft axis of rotation.

8 Claims, 19 Drawing Sheets

(56) References Cited

U.S. PATENT DOCUMENTS

| | | | | |
|---|---|---|---|---|
| 2003/0127067 | A1* | 7/2003 | Karnes | F01C 1/44<br>123/241 |
| 2010/0192565 | A1* | 8/2010 | Taba | F02G 1/02<br>60/508 |

* cited by examiner

INTERNAL COMBUSTION ENGINE

BACKGROUND

Technical Field

Internal combustion engines having rotating cylinder assemblies.

Description of Related Art

Despite the ongoing advances made in energy conversion devices, the piston-based internal combustion (IC) engine remains in widespread use as a power plant for automobiles and industrial applications. It appears that the IC engine will continue to have widespread use well into the future, particularly because there remains considerable opportunity to improve its energy conversion efficiency, as well as other operational aspects.

The vast majority of IC engines currently in use have an "in-line" configuration of cylinders. Such an IC engine may have a single block of cylinders having pistons operatively connected to a crankshaft by rods, or an IC engine may have a pair of blocks of cylinders formed in a V configuration in an engine block, each of the cylinders having pistons operatively connected to a single crankshaft by rods. "V8" engines, as well as "V-twins" (two cylinder), V4s, V6s, V10s, and V12s have this configuration, and are in use today.

In an alternative configuration, an IC engine may have a rotary configuration in which a block of cylinders is connected to a central crankshaft by rods. In operation of a rotary IC engine, the entire block of cylinders rotates. The pistons of the cylinder block are connected to the crankshaft by rods, and undergo reciprocating motion during a combustion cycle, thereby causing rotation of the crankshaft and the block of cylinders.

The rotary piston engine had substantial use in early IC engine driven aircraft, but was eventually rendered obsolete by advances in alternative power plants, including turbine-based propulsion. Rotary piston engines of that era had high fuel consumption and high oil consumption. Additionally, air drag from the rotating cylinder assembly increases with the square of rotational speed, which limited the maximum RPM at which these engines could operate, thus limiting maximum power output.

Rotary engines, much like conventional in-line fixed block engines, also have undesired complexity in the components required to provide the intake of combustible air/fuel mixture, and the supply and timing of ignition energy. Most rotary engines are configured to operate with multiple spark ignition sources disposed around the rotating cylinder assembly. The timing of these ignition sources in the combustion cycles of the cylinders must be managed, adding further complexity. Additionally, many rotary engine configurations are limited to operating as two-cycle engines due to their intake and exhaust designs.

However, despite these problems, the rotary piston IC engine has certain inherent advantages over the in-line stationary cylinder block engines in single and V-configurations. Because of the lack of a heavy crankshaft as used in in-line fixed block engines, rotary piston engines run with less vibration. They also have a high power-to-weight ratio. Additionally, the rotary piston assembly itself acts as a flywheel; thus there is no need to add the rotating mass of a solid plate flywheel, as is done in conventional in-line fixed block engines. If at least some of the problems could be solved by a rotary IC engine having an improved design, the rotary IC engine could become a valuable alternative power plant for automobiles and industrial applications, acting as a bridge to alternative energy conversion and transportation devices that will not be commercialized until well out in the future.

SUMMARY

In accordance with the present disclosure, there is provided an internal combustion engine comprising an engine block comprised of a main cavity, an intake plenum, and an exhaust plenum; a crankshaft supported within the main cavity of the engine block; a rotating piston assembly contained within the main cavity of the engine block and comprised of a rotatable cylinder housing having a housing axis of rotation and comprised of a plurality of pistons contained in combustion cylinders; and a rotating valve ring contained within the engine block and surrounding the rotating piston assembly, and comprised of valve port sets comprising intake ports, ignition energy ports, and exhaust ports communicable with each of the plurality of combustion cylinders. The rotatable cylinder housing has an axis of rotation that is parallel to and offset from the crankshaft axis of rotation.

Each of the plurality of combustion cylinders is comprised of a cylindrical side wall and a top wall formed in the cylinder housing. Each piston is contained in a combustion cylinder is operatively connected by a piston rod to the crankshaft and reciprocable along the central axis of the respective cylindrical side wall. For each of the plurality of pistons in combustion cylinders, the piston and the cylindrical side wall and top wall of the cylinder form a variable volume combustion chamber.

By virtue of the offset of the cylinder housing axis of rotation from the crankshaft axis of rotation, in operation of the engine, rotation of the piston assembly around its axis of rotation causes the distance from the crankshaft to the cylindrical wall of each combustion cylinder to vary periodically, thereby causing each piston to reciprocate within its cylindrical wall in repeated intake, compression, power, and exhaust strokes. Additionally, the rotating piston assembly and the rotating valve ring are operatively coupled to the crankshaft such that during operation of the engine, the rotating piston assembly and the rotating valve ring rotate synchronously with rotation of the crankshaft.

Thus during operation of the engine through a combustion cycle of intake, compression, power, and exhaust strokes of the pistons, for each respective combustion cylinder, the following occurs:

INTAKE: During the intake stroke of the piston from a distal end of the cylinder to the proximal end of the cylinder, the rotating valve ring positions an intake port for the respective combustion cylinder so that the combustion chamber of the cylinder is in communication with the intake plenum, thereby causing a gas contained in the intake plenum to flow into the combustion chamber. The gas may be a combustible gas. Alternatively, the gas may be air, oxygen, or another reactive gas that reacts with a fuel in a combustion chemical reaction.

COMPRESSION: During the compression stroke of the piston from the proximal end of the cylinder to the distal end of the cylinder, the rotating valve ring positions a first barrier wall that seals the top wall of the combustion cylinder, thereby causing compression of the gas in the combustion chamber as the piston moves from the proximal end of the cylinder to the distal end of the cylinder.

IGNITION: At substantially the end of the compression stroke of the piston, the rotating valve ring positions an ignition energy port in communication with the combustion chamber and an ignition energy source, thereby delivering ignition energy to the gas and causing the gas in the combustion chamber to ignite. If the gas is a combustible gas, the ignition energy may be from a spark plug. If the gas is air or another gas containing oxygen or another reactive gas, the ignition energy may be from direct injection of a fuel, such as a diesel fuel, which ignites under the high compression in the cylinder.

POWER: During the power stroke of the piston from a distal end of the cylinder to the proximal end of the cylinder, the gas combusts while the rotating valve ring positions a second barrier wall that seals the top wall of the combustion cylinder, thereby causing an increase in pressure within the combustion chamber, thereby applying a force on the piston and the connecting rod in the proximal direction, and thereby applying a torque on the crankshaft to cause crankshaft rotation.

EXHAUST: During the exhaust stroke of the piston from the proximal end of the cylinder to the distal end of the cylinder, the rotating valve ring positions an exhaust port for the respective combustion cylinder so that the combustion chamber of the cylinder is in communication with the exhaust plenum, thereby causing combustion gas contained in the combustion chamber to flow into the exhaust plenum and out of the engine.

These and other aspects of the IC engine of the present disclosure are provided subsequently herein.

BRIEF DESCRIPTION OF THE DRAWINGS

The present disclosure will be provided with reference to the following drawings, in which like numerals refer to like elements, and in which.

Figure 1A:
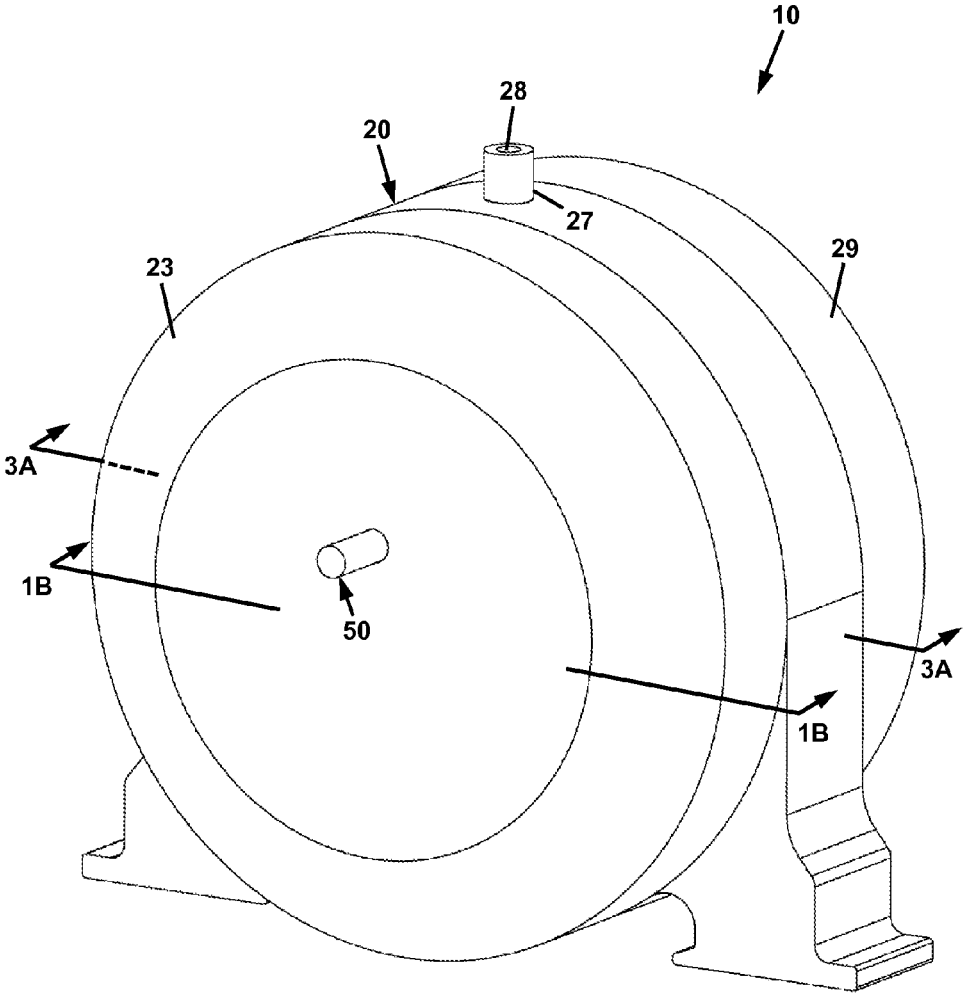
FIG. 1A is a perspective view of an embodiment of the internal combustion engine of the present disclosure.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. In the following disclosure, certain components may be identified with adjectives such as "front", "rear," "top," "upper," "bottom," "lower," "left," "right," etc. These adjectives are provided in the context of the orientation of the drawings, which is arbitrary. The description is not to be construed as limiting the engine to use in a particular spatial orientation. The instant engine may be used in orientations other than those shown and described herein. Additionally, certain components of the engine as depicted in the drawings may be larger or smaller relative to other components; the drawings are not to be considered as drawn to scale.

Additionally, a "gas" as used herein when referring to a compressible fluid being taken into a combustion chamber during an intake cycle of the engine is meant to indicate a compressible fluid that may only have gaseous molecules, but that may also include fine droplets of liquid phase molecules (typically liquid fuel molecules) in droplet forms such as mists and aerosols.

Figure 1B:
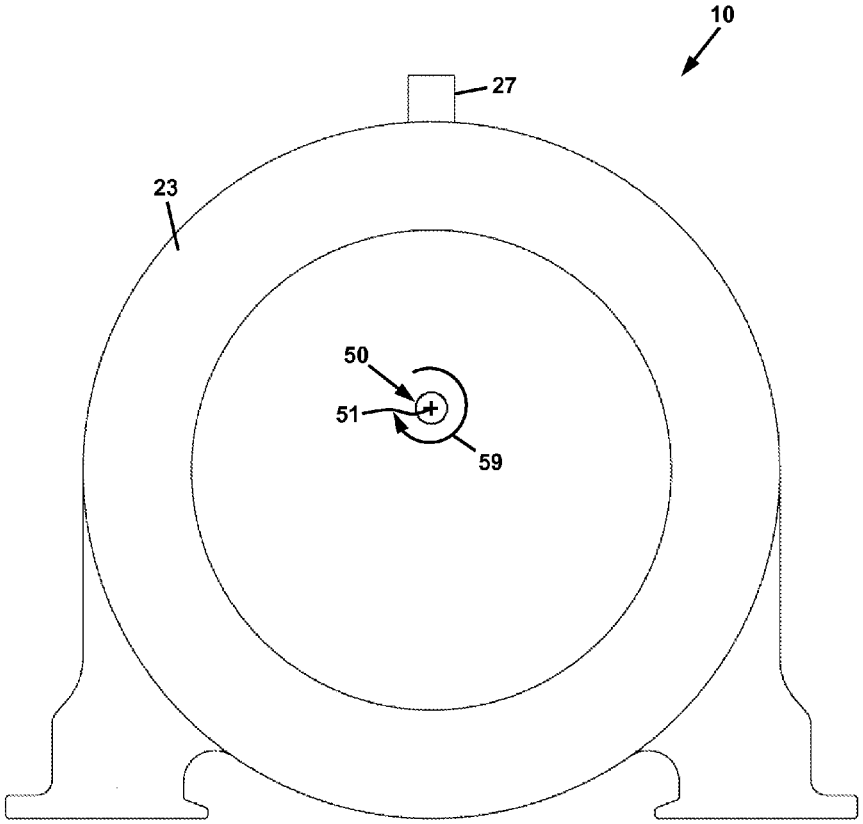
FIG. 1B is a front elevation view of the engine embodiment of FIG. 1A, taken along line 1B-1B of FIG. 1A.
Figure 3A:
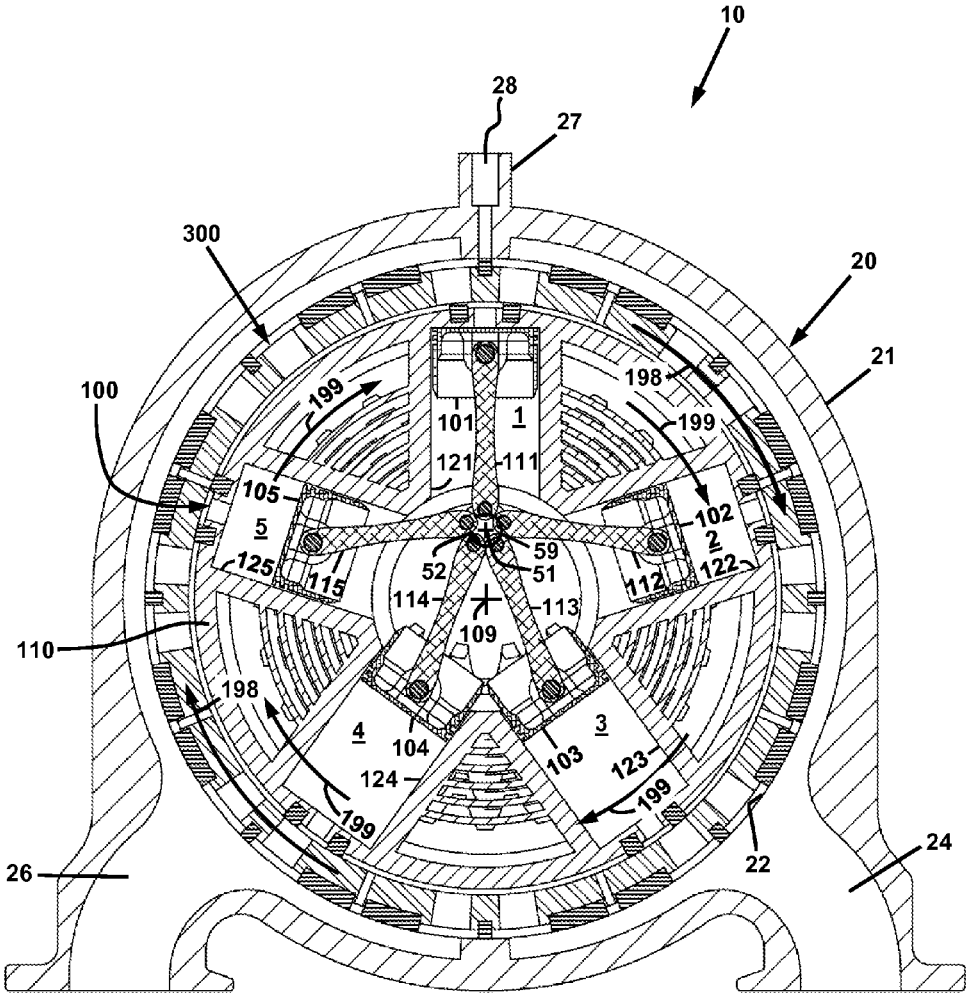
FIG. 3A is a front elevation cross-sectional view of the engine embodiment of FIG. 1A, taken along line 3A-3A of FIG. 1A.
Figure 3B:
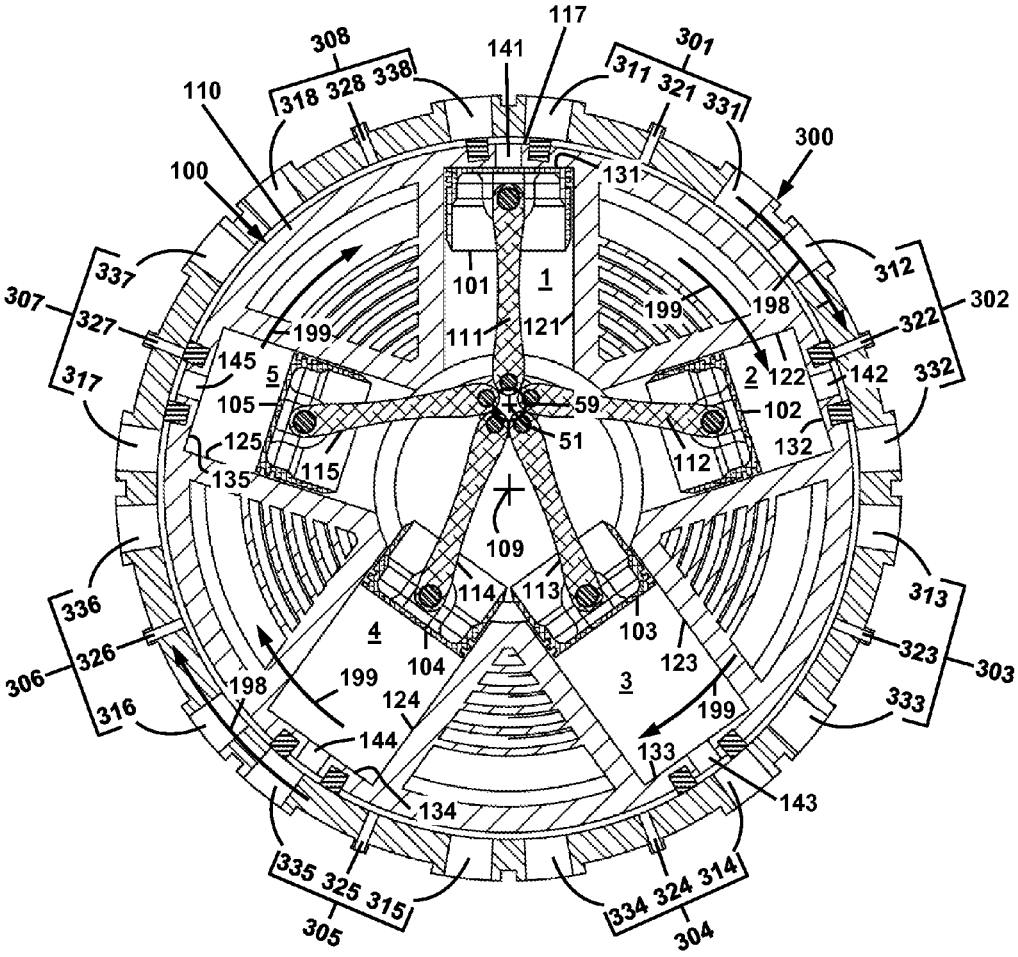
FIG. 3B is a front elevation cross-sectional view depicting only a rotating piston assembly and rotating valve ring of the engine embodiment of FIG. 1A, also taken along line 3A-3A of FIG. 1A.

Referring first to FIGS. 1, 3A and 3B, the internal combustion engine 10 is comprised of an engine block or casing 20, a rotating piston assembly 100 and a rotating valve ring 300. The engine block 20 may include a front cover 23 and a rear cover 29 that enclose gear sets that engage with each other and drive the rotating piston assembly 100 and rotating valve ring 300 relative to each other and relative to the engine block 20. The function of these gear sets will be explained subsequently herein.

The engine block 20 is further comprised of a main cavity 22 that contains the rotating piston assembly 100 and a rotating valve ring 300. The engine block 20 may also include an intake plenum 24 that is configured to receive a combustible gas from a fuel source (not shown) and direct the combustible gas through the valve ring 300 and into the respective combustion cylinders 1, 2, 3, 4, and 5, where combustion occurs during the respective power strokes of the combustion cylinders 1-5. In an alternative embodiment (not shown), the intake plenum 24 may be provided as a separate intake manifold piece that is joined to the engine block 20. The fuel source (not shown) may be carburetor or a fuel injector that is supplied with a gaseous combustible fuel or a liquid combustible fuel that is atomized and evaporates before or during combustion in the combustion cylinders. The fuel injector may be located in a manifold (not shown) that is joined to the intake plenum, or the fuel injector may be mounted in a port (not shown) that extends through the external wall 21 of the engine block 20 into the plenum 24.

The engine block 20 may also include an exhaust plenum 26 that is configured to receive a combustion exhaust gas from the respective combustion cylinders 1, 2, 3, 4, and 5 through the valve ring 300 and direct the exhaust gas out of the engine block 20 into the ambient atmosphere, or into an emissions abatement device (not show), such as a catalytic convertor. In an alternative embodiment (not shown), the exhaust plenum 26 may be provided as a separate exhaust header piece that is joined to the engine block 20.

The engine block may be further comprised of an ignition source port 28 for directing ignition energy into the combustion cylinders 1-5 during operation of the engine 10. The ignition source port 28 may be formed in a boss 27 that extends outwardly from the external wall 21 of the engine block 20. The ignition source port 28 may be provided with threads (not shown) for engagement with corresponding threads of a spark plug (not shown), which may be used to provide the ignition energy.

The engine 10 is further comprised of a crankshaft 50 that is driven by the action of the pistons during their respective power strokes as will be described subsequently herein. The crankshaft 50 is supported within the main cavity 22 of the engine block. In the embodiment of the engine 10 depicted in FIGS. 1-4K, the crankshaft may be supported by bearings (not shown) in the front cover 23 and rear cover 29. In an alternative embodiment (not shown), the bearings may be provided as "main bearings" that are supported by the engine block 20.

Referring in particular to FIGS. 3A and 3B, the rotating piston assembly 100 is contained within the main cavity 22 of the engine block 20, and is comprised of a rotatable cylinder housing 110 containing a plurality of pistons enclosed within combustion cylinders. During operation of the engine 10, the rotating piston assembly 100 rotates about the housing axis of rotation 109 as indicated by arrows 199. In the embodiment of engine 10 depicted in FIGS. 1-4K, the engine 10 is provided with five pistons 101, 102, 103, 104, and 105 enclosed respectively within combustion cylinders 1, 2, 3, 4, and 5. It is to be understood that the engine 10 may be comprised of an alternative number of combustions cylinders, and that the embodiment of engine 10 depicted in FIGS. 1-4K is to be considered as exemplary and not limiting. It is further noted that an odd number of cylinders is preferred because an even number of cylinders will not produce a smooth ignition firing pattern and may also require an irregular pattern of the ports in the rotating valve ring that may adversely affect engine life.

Each of the plurality of combustion cylinders 1-5 is comprised of a cylindrical side wall and a top wall formed in the cylinder housing 110. The pistons 101-105 contained in respective combustion cylinders 1-5 are operatively connected by respective piston rods 111, 112, 113, 114, and 115 to a radial flange 52 of the crankshaft 50. The connections of the piston rods 111-115 to the radial flange 52 are offset from the axis of rotation 51 of the crankshaft 50 so that during the respective power strokes of the pistons 101-105, torque is applied to the crankshaft 50, thereby resulting in crankshaft rotation as indicated by arrow 59. The pistons 101-105 are reciprocable along the central axes of their respective cylindrical side walls 121, 122, 123, 124, and 125. For each of the plurality of pistons 101-105 in combustion cylinders 1-5, the piston and the cylindrical side wall and top wall of the cylinder form a variable volume combustion chamber.

Referring again to FIG. 3A, the rotating valve ring 300 is contained within the engine block 20 and surrounds the rotating piston assembly 100. The rotating valve ring 300 is comprised of intake ports, ignition energy ports, and exhaust ports corresponding to each of the plurality of combustion cylinders 1-5, which will be explained in detail subsequently herein. The rotating valve ring 300 and rotatable cylinder housing 110 share a common axis of rotation 109, with the rotating valve ring rotating around axis 109 as indicated by arrows 198. This common axis of rotation 109 is parallel to and offset from the crankshaft axis of rotation 51.

By virtue of the offset of the cylinder housing axis of rotation 109 from the crankshaft axis of rotation 51, in operation of the engine 10, rotation of the piston assembly 100 around its axis of rotation 109 causes the distance from the crankshaft 50 to the respective cylindrical walls 121-125 of each of the combustion cylinders 1-5 to vary periodically, thereby causing each piston 101-105 to reciprocate within its cylindrical wall in repeated intake, compression, power, and exhaust strokes. Additionally, the rotating piston assembly 100 and the rotating valve ring 300 are operatively coupled to the crankshaft 50 by gearing such that during operation of the engine 10, the rotating piston assembly 100 and the rotating valve ring 300 rotate synchronously with rotation of the crankshaft 50.

These principles will now be explained in detail with reference to FIGS. 2A-2E, FIG. 3B, and FIGS. 4A-4K. Turning first to the rotation of the rotating piston assembly 100 and the rotating valve ring 300, and referring in particular to FIGS. 2A-2E, the engine 20 is comprised of at least a front gear set 30, which operatively couples the rotation of the crankshaft 50 to the rotating piston assembly 100 and the rotating valve assembly 300. The front gear set 30 is engaged with the front portion 53 of the crankshaft 50. The engine may be further comprised of a rear gear set 70 that is a mirror image of the front gear set 30. Although only one gear set is needed to obtain the desired rotational relationship between the crankshaft 50, rotating piston assembly 100, and the rotating valve assembly 300, the use of a second gear set may provide greater reliability, less wear of the gears, and a smoother operation of the engine due to the "flywheel effect" of the additional gears.

The operation of the front gear set 30 will now be described with reference in particular to FIG. 2D, with it being understood that the operation of the rear gear set 70 occurs in the same manner. A first principle of operation of engine 10 is that rotation of the crankshaft 50 drives rotation of both the rotating piston assembly 100, and the rotating valve ring. Other than rotational motion, the crankshaft 50 is otherwise in a fixed position with respect to the engine block 20 and the front cover 23 and rear cover 29. In the embodiment of the engine 10 shown in the drawings, the crankshaft 50 is supported by bearings (not shown) in the front cover 23 and rear cover 29. In an alternative embodiment (not shown), the bearings may be provided as "main bearings" that are supported by the engine block 20. In either case, the crankshaft 50 rotates within the engine block 20, and front and rear covers 23 and 29.

Shaft gear 32 is fixed to crankshaft 50, and is directly driven by crankshaft 50, by virtue of engagement of drive star 55 of crankshaft 50 with drive star cutout 34 in shaft gear 32. Thus the drive star 55 serves as a means of direct connection between the shaft gear 32 and the crankshaft 50. Valve ring annular gear 36 is joined to rotating valve ring 300 by suitable fasteners 37; thus when valve ring annular gear 36 is driven rotationally, rotating valve ring 300 also rotates. In like manner, piston annular gear 38 is joined to rotating piston assembly 100 by suitable fasteners 39; thus when piston annular gear 38 is driven rotationally, rotating piston assembly 100 also rotates.

The operation of the gear set 30 during the operation of engine 10 will now be described. It is to be understood that the operation of gear set 30 is meant to be exemplary and not limiting. The various gear sets may have different ratios and configurations, depending upon the number of cylinders in the engine 10, and the number of valve port sets in the rotating valve ring 300.

Figure 2A:
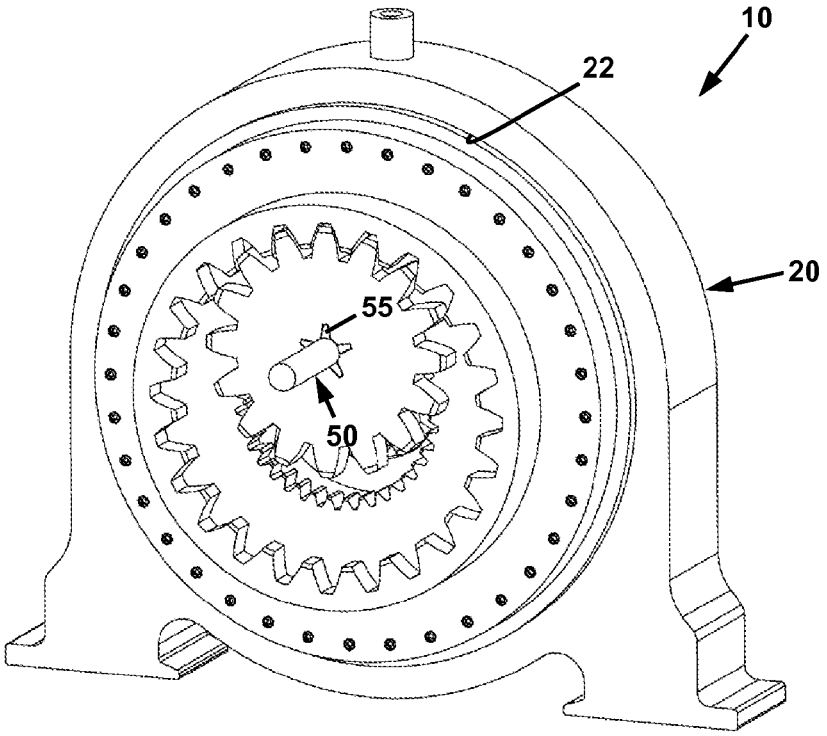
FIGS. 2A and 2B are perspective and front elevation views as in FIGS. 1A and 1B, but with a front and rear covers of the engine removed to show certain drive gearing of the engine.
Figure 2B:
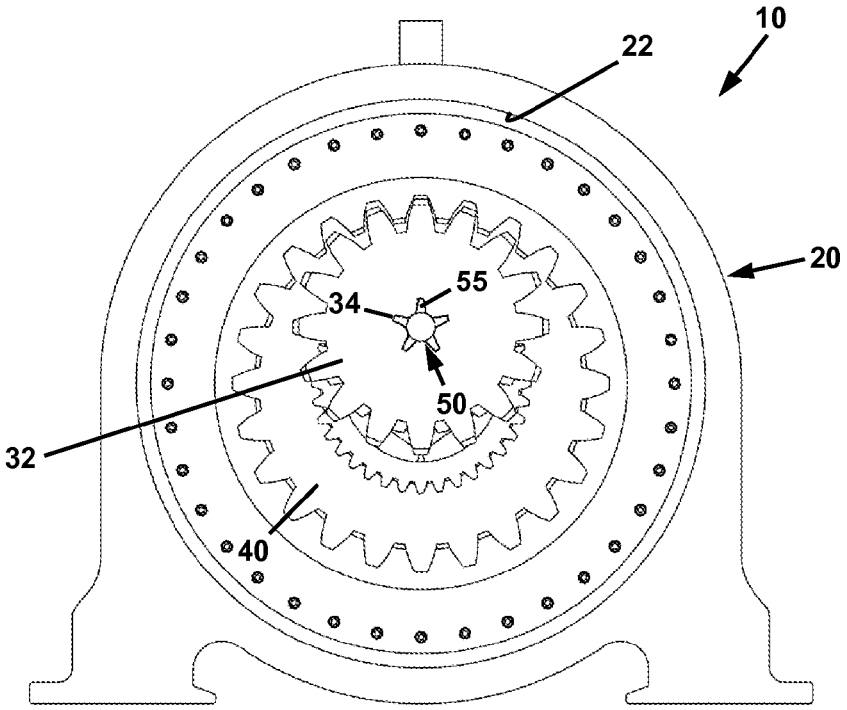
Figure 2C:
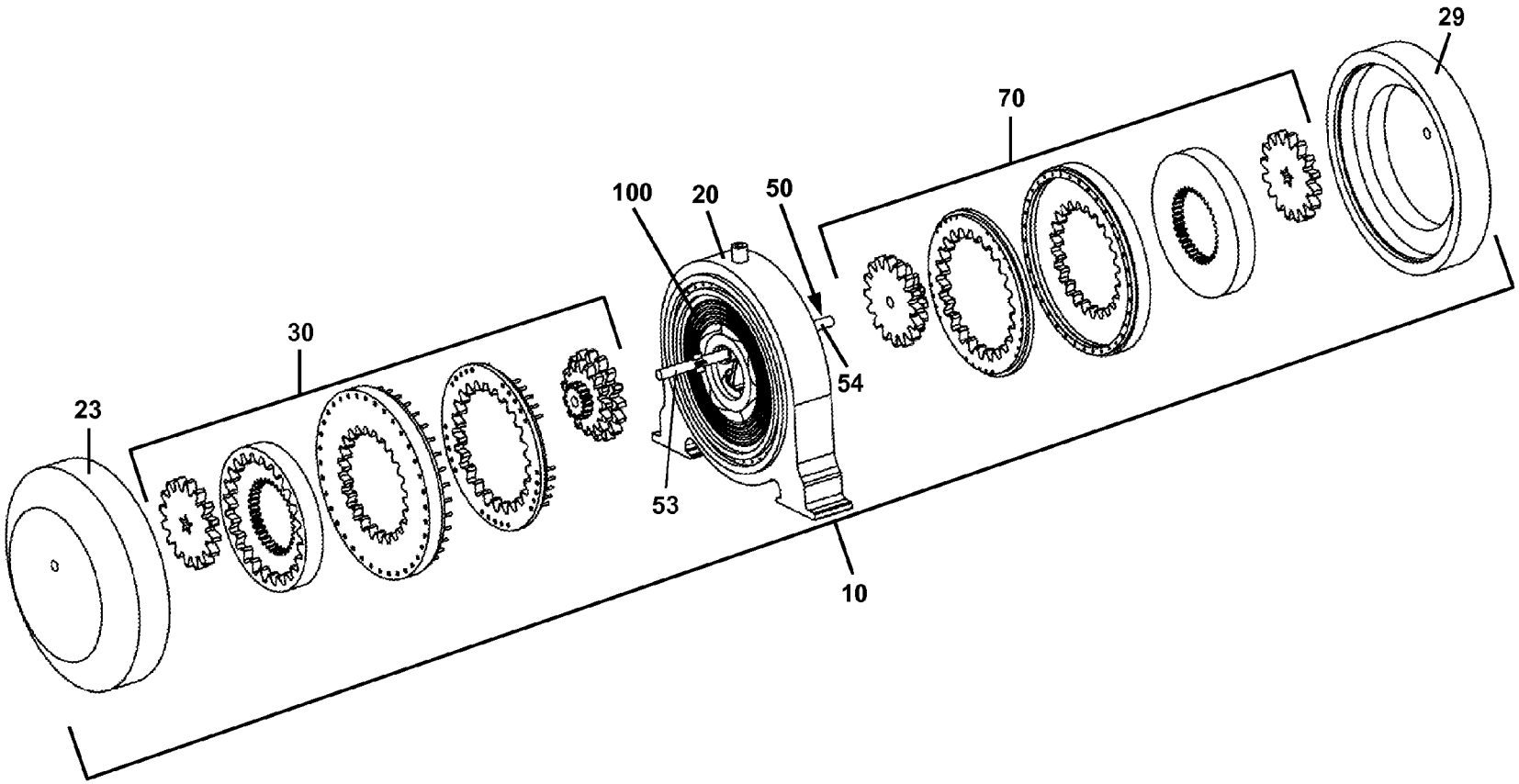
FIG. 2C is an exploded view of the engine of FIG. 1A, further depicting the drive gearing of the engine.
Figure 2D:
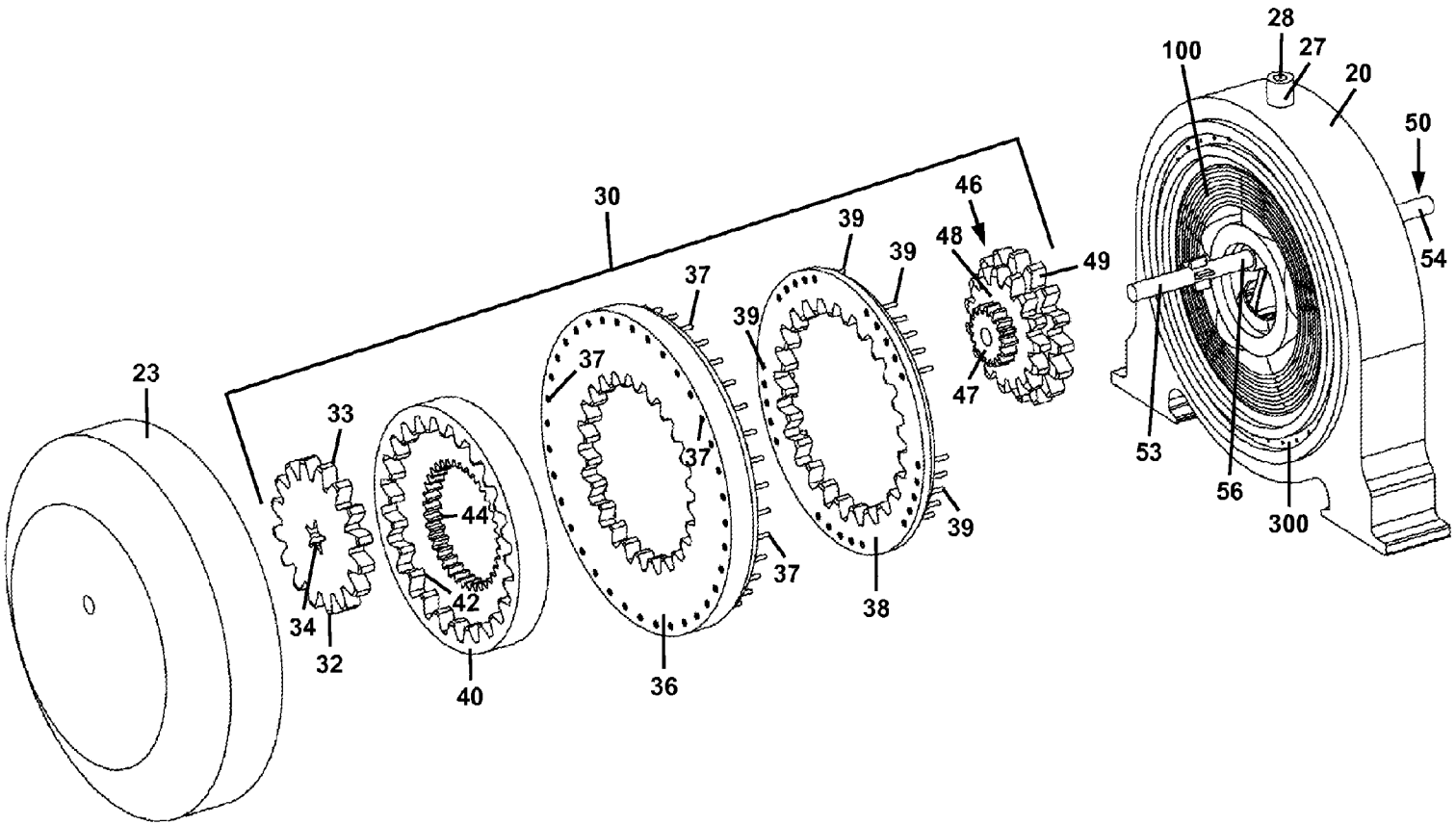
FIG. 2D is a portion of the exploded view of FIG. 2C, depicting the front drive gearing of the engine.
Figure 2E:
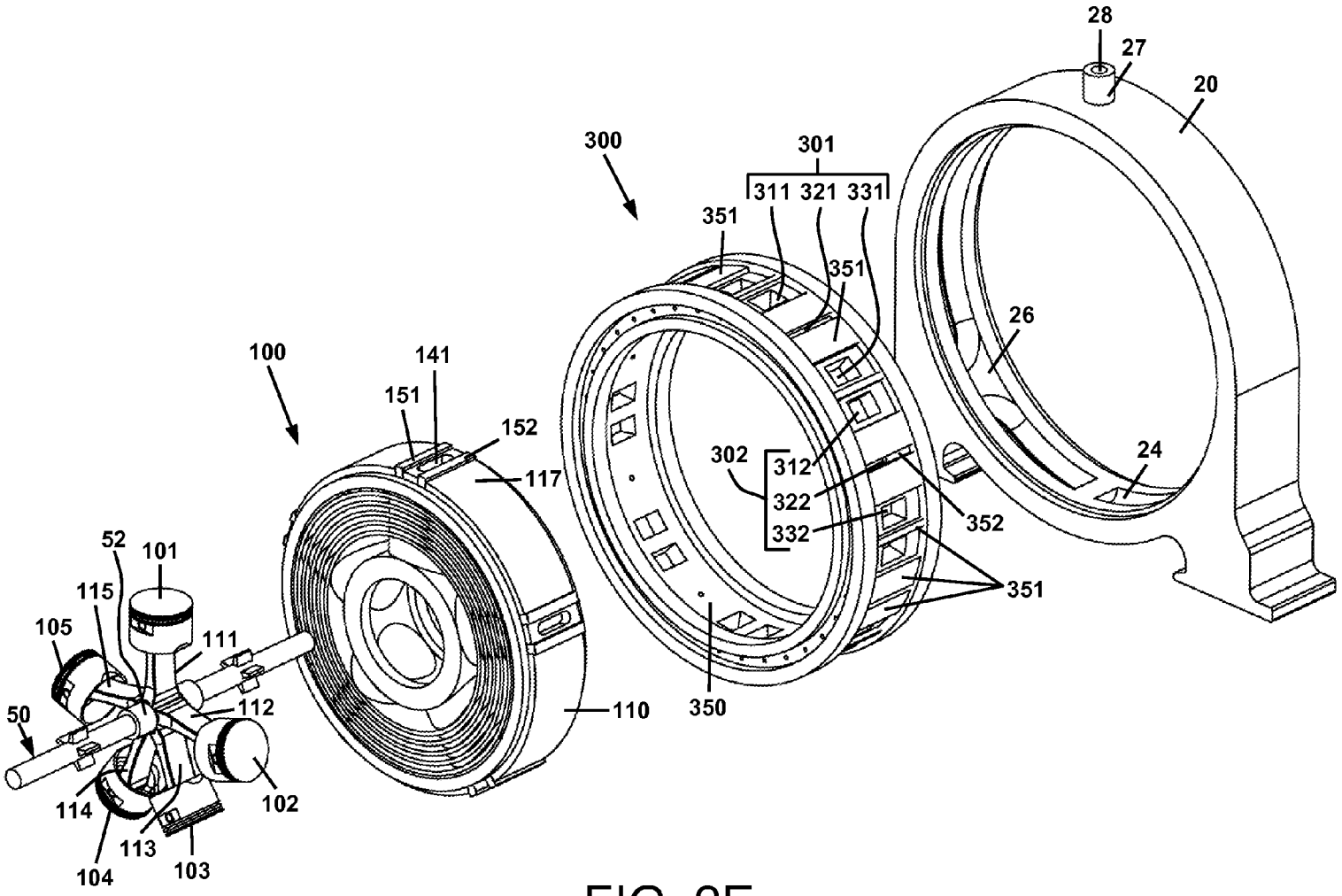
FIG. 2E is an exploded view of a portion of the engine of FIG. 1A, depicting the engine block, rotating valve ring, rotating cylinder housing, and piston and crankshaft assembly.

Referring to FIGS. 2B, 2D, and 2E, a single rotation of crankshaft 50 results in a single rotation of shaft gear 32, by virtue of engagement of drive star 55 of crankshaft 50 with drive star cutout 34 in shaft gear 32. Double annular gear 40 is comprised of an inwardly directed outer gear 42 that is engaged with the teeth 33 of shaft gear 32. Outer gear 42 has 24 teeth, and shaft gear 32 has 16 teeth; hence a single rotation of crankshaft 50 results in a 2/3 rotation of double annular gear 40.

Double annular gear 40 is also comprised of an inner gear 44 that is engaged with a front gear 47 of main gear set 46, which rides rotationally on the central region 56 of crankshaft 50. Inner gear 44 has 36 teeth, and front gear 47 has 16 teeth. Thus the single rotation of crankshaft 50 that results in a 2/3 rotation of double annular gear 40 also causes 2/3× 36/16 rotations, i.e. 1½ rotations of front gear 47, as well as middle gear 48 and rear gear 49 of main gear set 46.

It is noted that the position of double annular gear 40 may be fixed by its engagement with shaft gear 32 and main gear 46, and in the axial direction by shaft gear 32 and valve ring annular gear 36. Alternatively, double annular gear may be supported by a bearing (not shown) that is provided in engine block 20 or cover 23.

Rear gear 49 of main gear set 46 is engaged with piston annular gear 38. Rear gear 49 has 16 teeth, and piston annular gear 38 has 24 teeth. Thus the single rotation of crankshaft 50 that results in 1½ rotations of rear gear 49 also results in 1.5×16/24 rotations, i.e., one rotation of piston annular gear 38, as well as rotating piston assembly 100. Thus crankshaft 50 and rotating piston assembly 100 rotate in unison, but on rotational axes that are offset from each other by virtue of the arrangement of the gears.

Middle gear 48 is engaged with valve ring annular gear 36. Middle gear 48 has 15 teeth, and valve ring annular gear 36 has 24 teeth. Thus the single rotation of crankshaft 50 that results in 1½ rotations of middle gear 48 also results in 1.5×15/24 rotations, i.e., 15/16 rotation of valve ring annular gear 36, as well as rotating valve ring 300.

Because the engine 10 operates as a four cycle engine, two rotations of the rotating piston assembly 100 and the crankshaft 50 occur for each combustion cycle, while the rotating valve ring 300 rotates 1⅞ times. The rotational ratio of the rotating cylinder assembly 100 to the rotating valve ring 300 is thus 16/8: 15/8, or 16:15. This difference between the rotational rates of the rotating cylinder assembly 100 to the rotating valve ring 300 provides the desired intake valve, ignition, and exhaust valve timing during the combustion cycle, as will be explained subsequently herein.

The operation of the rotating piston assembly 100 in combination with the rotating valve ring 300 to accomplish the combustion cycle for each respective combustion cylinder of intake, compression, power, and exhaust will now be described with reference to FIG. 3B and FIGS. 4A-4K. Referring first to FIG. 3B, combustion cylinder 1 is comprised of a cylindrical side wall 121 and a top wall 131, which, in cooperation with piston 101 form a variable volume combustion chamber as described previously. In like manner, combustion cylinder 2 is comprised of a cylindrical side wall 122 and a top wall 132; combustion cylinder 3 is comprised of a cylindrical side wall 123 and a top wall 133; combustion cylinder 4 is comprised of a cylindrical side wall 124 and a top wall 134; and combustion cylinder 5 is comprised of a cylindrical side wall 125 and a top wall 135.

Combustion cylinder 1 is further comprised of a port 141 that extends through the rotatable cylinder housing 110 from the top wall 131 of cylinder 1 to the external surface 117 of cylinder housing 110. In the operation of engine 10, the port 141 functions as a conduit for conveying fuel and air into combustion cylinder 1 during the intake stroke of the combustion cycle, and as a conduit for conveying ignition energy into combustion cylinder 1 during the ignition step of the combustion cycle, and as a conduit for conveying hot exhaust gases from combustion cylinder 1 during the exhaust stroke of the combustion cycle. Thus a single port is used for all three functions, in contrast to the dedicated spark plug, intake and exhaust valve ports provided in the cylinder heads of conventional internal combustion engines. In like manner, combustion cylinders 2-5 are further comprised of respective ports 142, 143, 144, and 145 that extend through the rotatable cylinder housing 110 from the respective top walls 132, 133, 134, and 135 to the external surface 117 of cylinder housing 110.

This use of a single port for these three functions is made possible by the configuration and operation of the rotating valve ring 300, and its synchronous rotation with the rotating cylinder assembly 100. Referring again to FIG. 3B, the rotating valve ring 300 is comprised of sets of intake, ignition, and exhaust ports disposed circumferentially around the perimeter of valve ring 300. In the embodiment depicted in FIG. 3B, there are eight port sets 301, 302, 303, 304, 305, 306, 307, and 308. Port set 301 is comprised of intake port 311, ignition port 321, and exhaust port 331. In like manner, port sets 302-308 are comprised, respectively, of intake port 31*x*, ignition port 32*x*, and exhaust port 33*x*, where x is between 2 and 8 inclusive.

During the combustion cycle, the rotating valve ring rotates synchronously with the rotating cylinder assembly 100, but at a different rotational rate via the gearing described previously, so as to align an intake port with a combustion cylinder during the intake stroke, and to align an ignition port at the required time of ignition, and to align an exhaust port with a combustion cylinder during the exhaust stroke. This alignment of ports, which enables the combustion cycle for each cylinder of the engine 10 will now be described for combustion cylinder 1 only with reference to FIGS. 4A-4K. It is to be understood that combustion cycles are occurring simultaneously for each of the combustion cylinders 2-5, with those combustion cycles offset by their relative angular positions around the rotating piston assembly 100. The combustion cycle steps of intake stroke, compression stroke, ignition, power stroke, and exhaust stroke are now described.

Figure 4A:
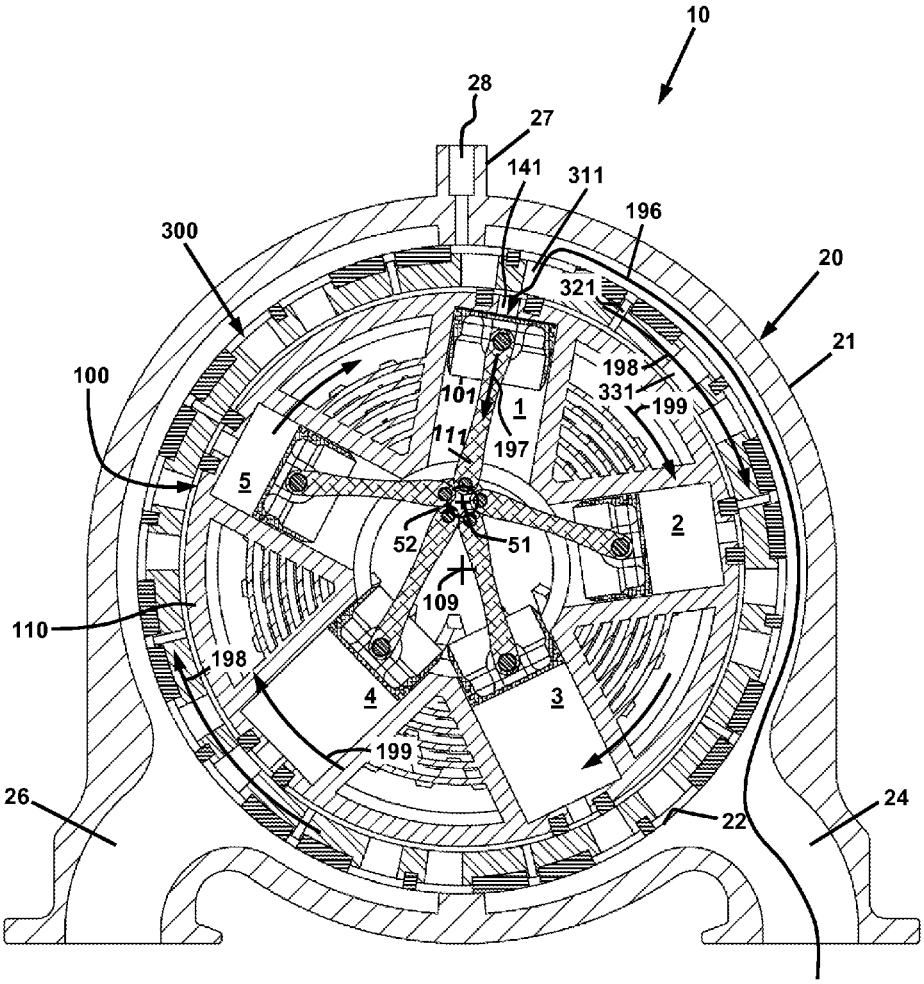
FIGS. 4A-4K are a sequence of front elevation cross-sectional views of the engine embodiment of FIG. 1A taken along line 3A-3A of FIG. 1A, and showing the operational cycle of intake stroke, compression stroke, ignition, power stroke, and exhaust stroke of the engine.
Figure 4B:
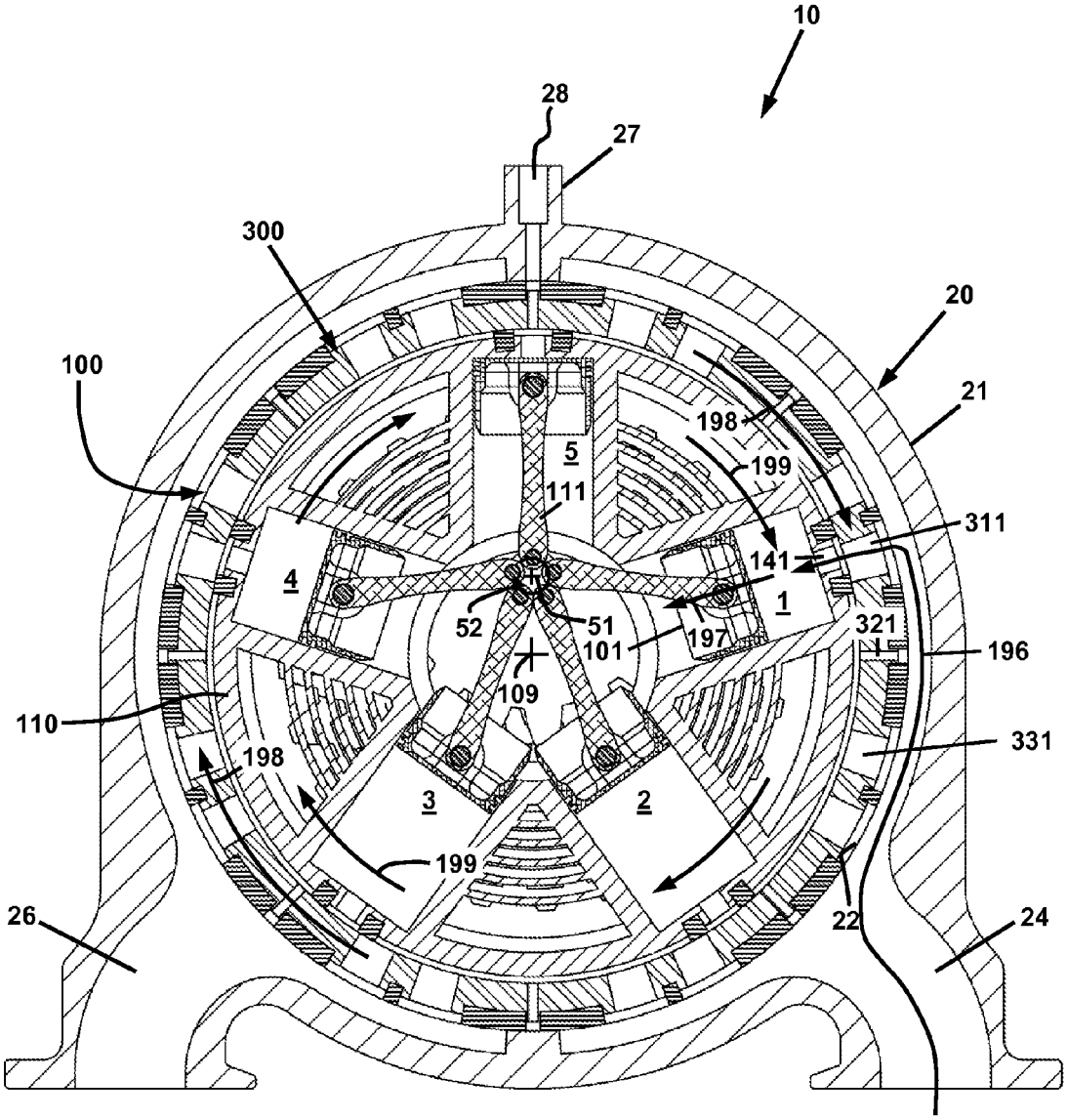
Figure 4C:
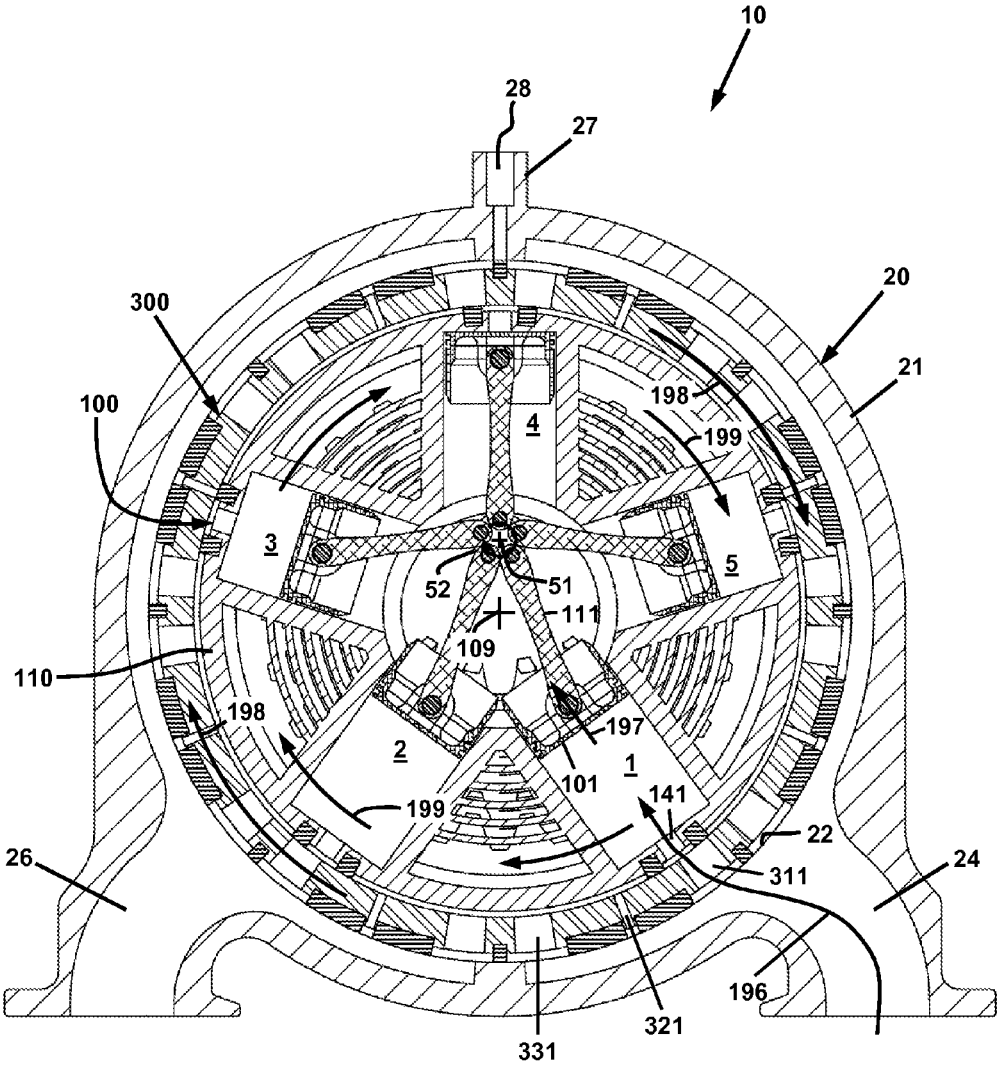

Summary of Intake Stroke:

During the intake stroke of a piston from a distal end of a cylinder to the proximal end of the cylinder, the rotating valve ring positions an intake port for the respective combustion cylinder so that the combustion chamber of the cylinder is in communication with the intake plenum, thereby causing a gas contained in the intake plenum to flow into the combustion chamber. The intake stroke for cylinder 1 is depicted in FIGS. 4A-4C. The gas may be a combustible gas that includes a combustible fuel.

Turning first to FIG. 4A, the rotating cylinder assembly 100 has rotated approximately 10 degrees past the top dead center (TDC) position shown in FIG. 3A, which depicts the end of an exhaust cycle and the beginning of an intake cycle for cylinder 1. In FIG. 4A, the intake stroke for cylinder 1 is beginning. Due to the offset of the axis of rotation 51 of the crankshaft 50 from the axis of rotation 109 of the rotating cylinder assembly 100, the piston 101 begins to move downwardly relative to the side and top walls of cylinder 1 as indicated by arrow 197. Although the rotating cylinder assembly 100 has rotated approximately 10 degrees past TDC, the rotating valve ring 300 has rotated to a slightly lesser extent, due to the geared relationship between then rotating valve ring 300 and the rotating cylinder assembly 100 described previously. Thus the intake valve port 311 is beginning to overlap the port 141 of cylinder 1. As a result of the downward motion of the piston 101, combustible mixture is caused to flow from the intake plenum 24 through the valve port 311, through the cylinder port 141, and into cylinder 1 as indicated by arrow 196.

Referring to FIG. 4B, the middle of the intake stroke is depicted. The rotating cylinder assembly 100 has rotated further, causing the piston 101 to continue its downward motion relative to the cylinder as indicated by arrow 197. The rotating valve ring 300 has also rotated further, but through a lesser angle than the rotating cylinder assembly 100 by virtue of the geared relationship with the rotating cylinder assembly 100. Intake valve 311 and cylinder port 141 are now fully aligned, and combustible mixture continues to flow through the intake plenum 24, the intake valve 311 and cylinder port 141 into cylinder 1 as indicated by arrow 196.

Referring to FIG. 4C, the end of the intake stroke is depicted. The rotating cylinder assembly 100 has rotated further, and piston 101 has nearly ceased its downward motion as indicated by arrow 197 relative to the cylinder. The rotating valve ring 300 has also rotated further, but again through a lesser angle than the rotating cylinder assembly 100. Cylinder port 141 has now nearly moved past intake valve 311. The flow of combustible mixture into cylinder 1 through the intake plenum 2 and the intake valve 311 as indicated by arrow 196 has nearly ceased. With a small further angular displacement of the rotating cylinder assembly 100 and rotating valve ring 300, the piston 101 ceases its downward motion, and the cylinder port 141 moves past the intake valve 311. The cylinder 101 is now sealed, and the compression stroke ensues.

Summary of Compression Stroke:

During the compression stroke of the piston from the proximal end of the cylinder to the distal end of the cylinder, the rotating valve ring positions a first barrier wall that seals the top wall of the combustion cylinder, thereby causing compression of the gas in the combustion chamber as the piston moves from the proximal end of the cylinder to the distal end of the cylinder. The compression stroke for cylinder 1 is depicted in FIGS. 4D-4E.

Figure 4D:
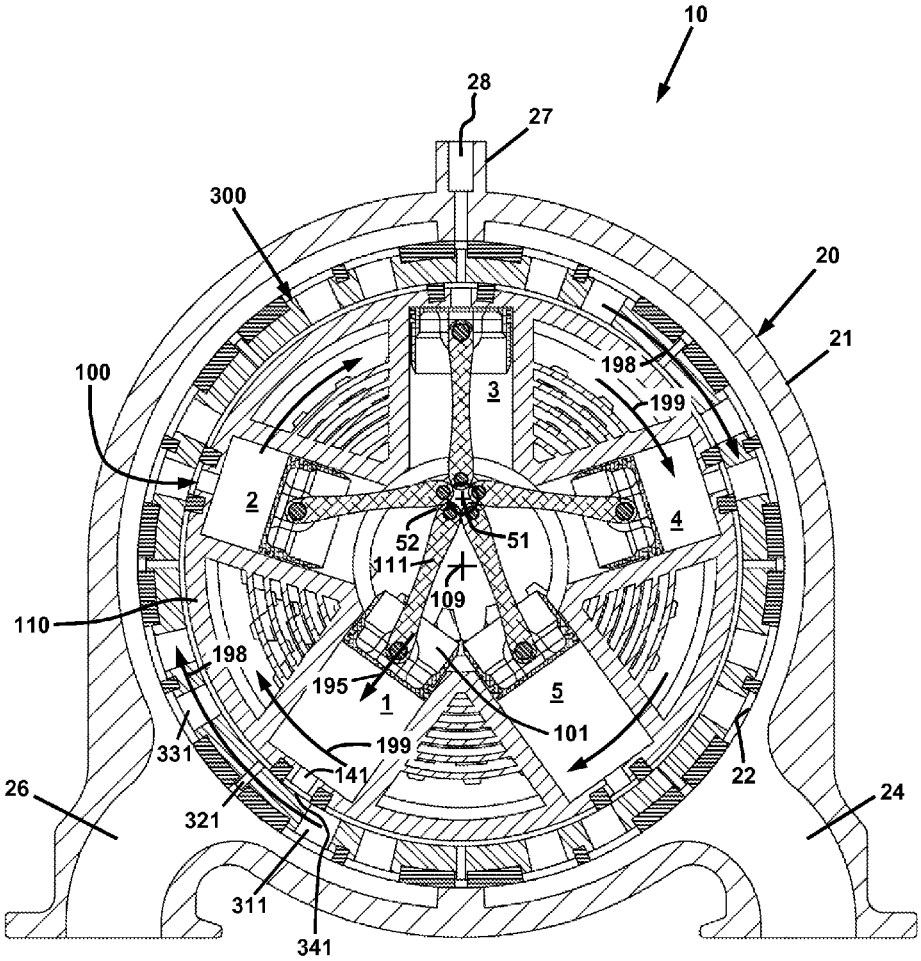

Turning first to FIG. 4D, the beginning of the compression stroke is depicted. The rotating cylinder assembly 100 has rotated further, causing the piston 101 to begin its upward motion relative to the cylinder as indicated by arrow 195. The rotating valve ring 300 has also rotated further, but again through a lesser angle than the rotating cylinder assembly 100. A barrier wall 341 that is located in rotating valve ring 300 between intake valve 311 and ignition port 321 is now blocking cylinder port 141, thereby sealing cylinder 1. As the rotating cylinder assembly 100 continues to rotate, the piston 101 continues its upward motion, compressing the combustible gas contained therein.

Figure 4E:
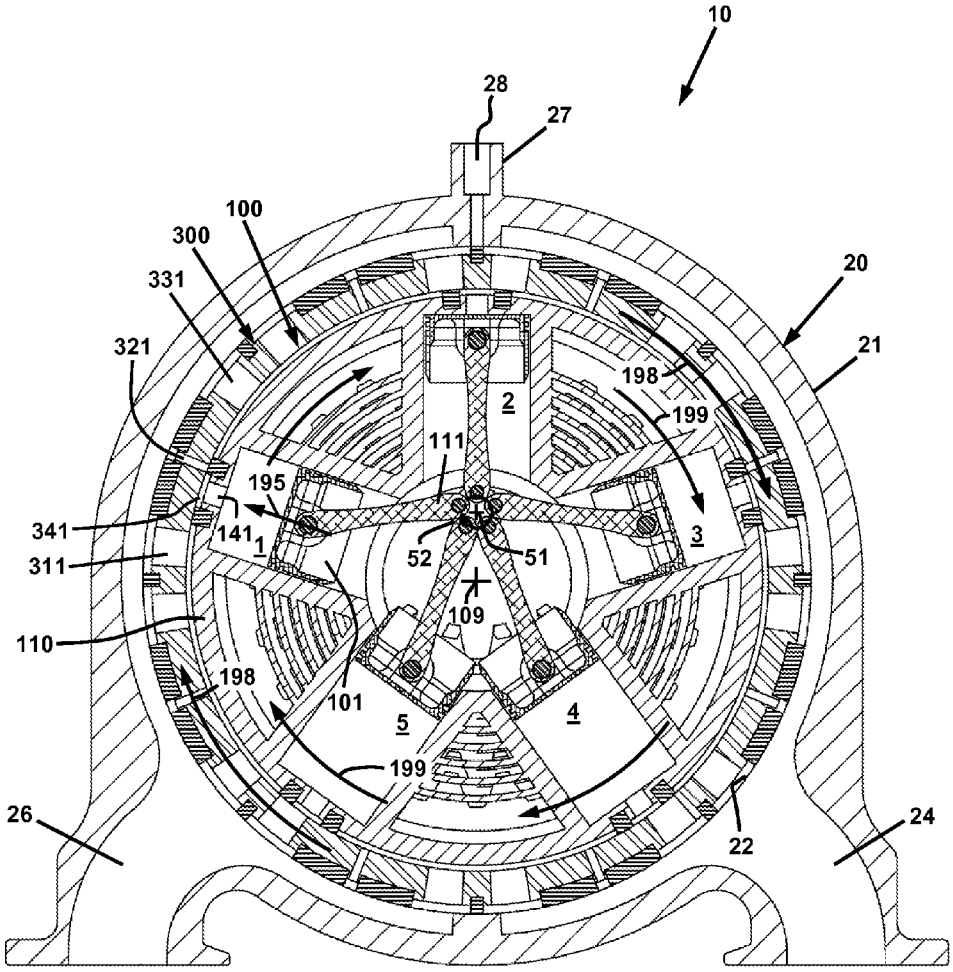

Referring to FIG. 4E, the middle of the compression stroke is depicted. The rotating cylinder assembly 100 has rotated further, causing the piston 101 to continue its upward motion relative to the cylinder as indicated by arrow 195, further compressing the combustible mixture in cylinder 1. The rotating valve ring 300 continues to rotate through a lesser angle than the rotating cylinder assembly 100. The barrier wall 341 continues to block cylinder port 141. With a further angular displacement of the rotating cylinder assembly 100 and rotating valve ring 300, the upward motion of piston 101 slows as cylinder 1 approaches top dead center. Ignition of the combustible gas in cylinder 1 then ensues.

Summary of Ignition:

At or near the end of the compression stroke of the piston, the rotating valve ring positions an ignition energy port in communication with the combustion chamber and an ignition energy source, thereby delivering ignition energy to the gas and igniting the gas. The ignition step for cylinder 1 is depicted in FIG. 4F.

Figure 4F:
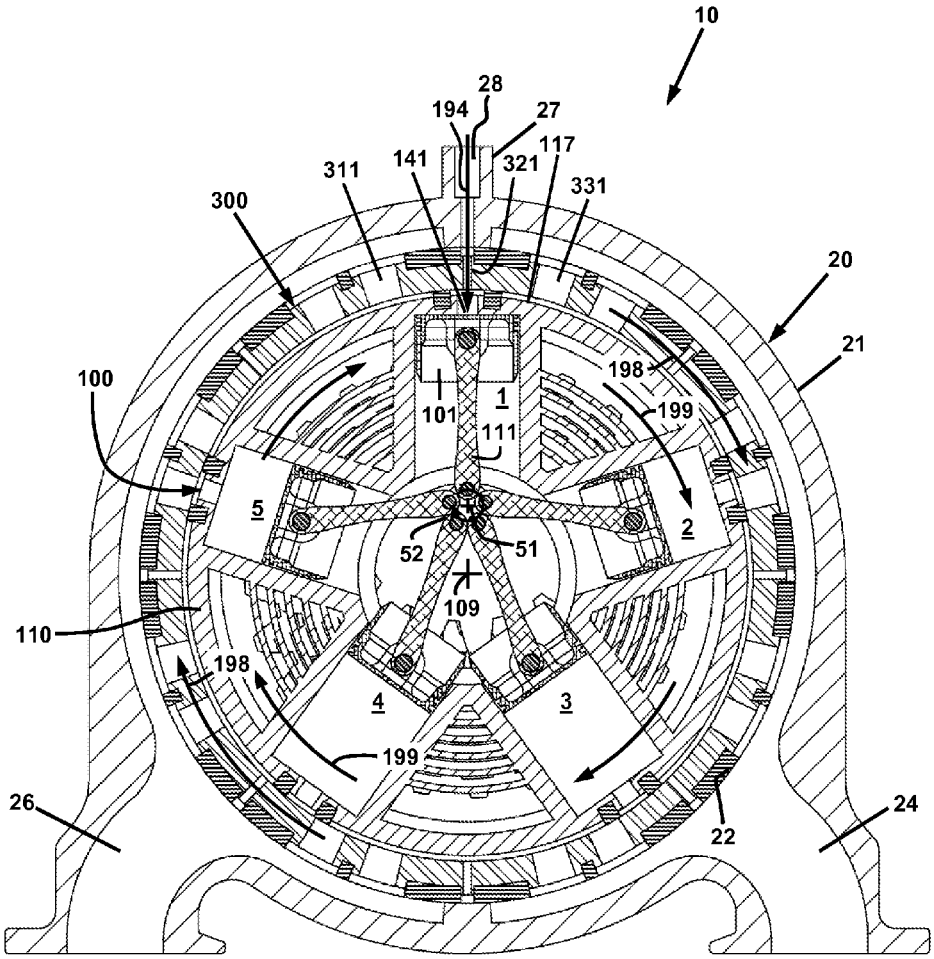

Referring to FIG. 4F, the rotating valve ring 300 has rotated such that ignition energy port 321 is aligned with cylinder port 141, thus placing an ignition energy source (not shown) disposed in ignition source port 28 in communication with cylinder 1. Ignition energy is delivered from the ignition energy source through ignition energy port 321 of rotating valve ring 300 and through cylinder port 141 as indicated by arrow 194, thereby causing ignition of the combustible gas contained in cylinder 1. It is noted that the engine 10 may be operated with only a single ignition energy source and ignition source port 28. Multiple ignition energy sources are not needed for operation of the engine 10.

In certain embodiments, the ignition energy source may be a spark plug (not shown) that is fitted in ignition source port 28. Energizing of the spark plug is controlled such that the sparking of the plug is timed to occur at the time that ignition energy port 321 is aligned with cylinder port 141. The sparking element of the spark plug may extend down within ignition energy port 321 to the point where it is nearly in contact with surface 117 of cylinder housing 110. The sparking element may be configured to fire a high energy electrical discharge down through cylinder port 141 into cylinder 1.

It is noted that in the embodiment of the engine 10 depicted in FIGS. 1-4K, the ignition source port 28 is located such that ignition energy is delivered at approximately top dead center of the cylinder rotation. However, it is well known that spark advance is used to improve efficiency of internal combustion engines. Thus, the ignition source port 28 may be located in the counterclockwise direction on the engine block 20, so that ignition energy is delivered to the cylinders before they reach top dead center. The location of ignition energy port 321 may also be adjusted accordingly so that the proper alignment with ignition source port 28 and cylinder port 141 occurs at the desired ignition time. Additionally, the ignition source port 28, ignition energy port 321, and/or cylinder port 141 may have their respective shapes altered, possibly to have oblong shapes, thereby resulting in a longer duration of port alignment so that ignition energy timing may be made more adjustable. In an alternative embodiment, the ignition source port may be provided with a sliding mechanism and seals so that its position is circumferentially adjustable. In that manner, ignition timing may be advanced or retarded as needed to match engine operating conditions.

It is also noted that in the previous description of the intake stroke, compression stroke, and ignition step, these operations have been described in the context of there being an external source of combustible gas or combustible liquid fuel droplets, which is delivered through the intake plenum 24 of the engine block 20. However, it is not necessary that the combustible fuel be provided from an external source and delivered to plenum 24. In an alternative embodiment (not shown), a fuel injector (or multiple injectors) may be provided for delivery of combustible fuel. This injector may be fitted to the engine block in a region where it is in communication with the plenum 24, so that it injects combustible gas or atomized liquid directly into plenum 24 during the intake stroke of any cylinder 1-5. The fuel injector(s) may be oriented so that the injection spray or gas discharge is directed at the intake port of the rotating valve ring 300 as it rotates past the injector(s).

It is also noted that in the above descriptions of the intake stroke, compression stroke, and ignition step, these operations have been described in the context of the combustible mixture being formed in advance of being taken into a combustion cylinder, i.e. the combustible mixture is formed in a manner similar to a conventional spark ignition gasoline or compressed natural gas (CNG) engine.

However, it is not necessary that the combustible mixture be formed in advance of ignition thereof. In an alternative embodiment (not shown), the engine 10 may be operated as a diesel engine. In such an embodiment, a diesel fuel injector may be provided for injection of diesel fuel into the cylinders 1-5 at the desired ignition time. In certain embodiments, the diesel fuel injector may be fitted to the ignition source port 28 of the engine block 20, so that it injects diesel fuel directly into a cylinder, such as into cylinder 1 through ignition energy port 321 and cylinder port 141. The fuel then ignites as in a conventional diesel engine. In that regard, the ignition energy source that causes ignition of the combustible gas in the cylinder is the diesel fuel itself.

With the ignition of the combustible gas in the cylinder having occurred, the power stroke of engine 10 now proceeds.

Summary of Power Stroke:

During the power stroke of the piston from a distal end of the cylinder to the proximal end of the cylinder, the combustible gas burns while the rotating valve ring positions a second barrier wall that seals the top wall of the combustion cylinder, thereby causing an increase in pressure within the combustion chamber, thereby applying a force on the piston and the connecting rod in the proximal direction, and thereby applying a torque on the crankshaft to cause crankshaft rotation. The power stroke for cylinder 1 is depicted in FIGS. 4G-4H.

Figure 4G:
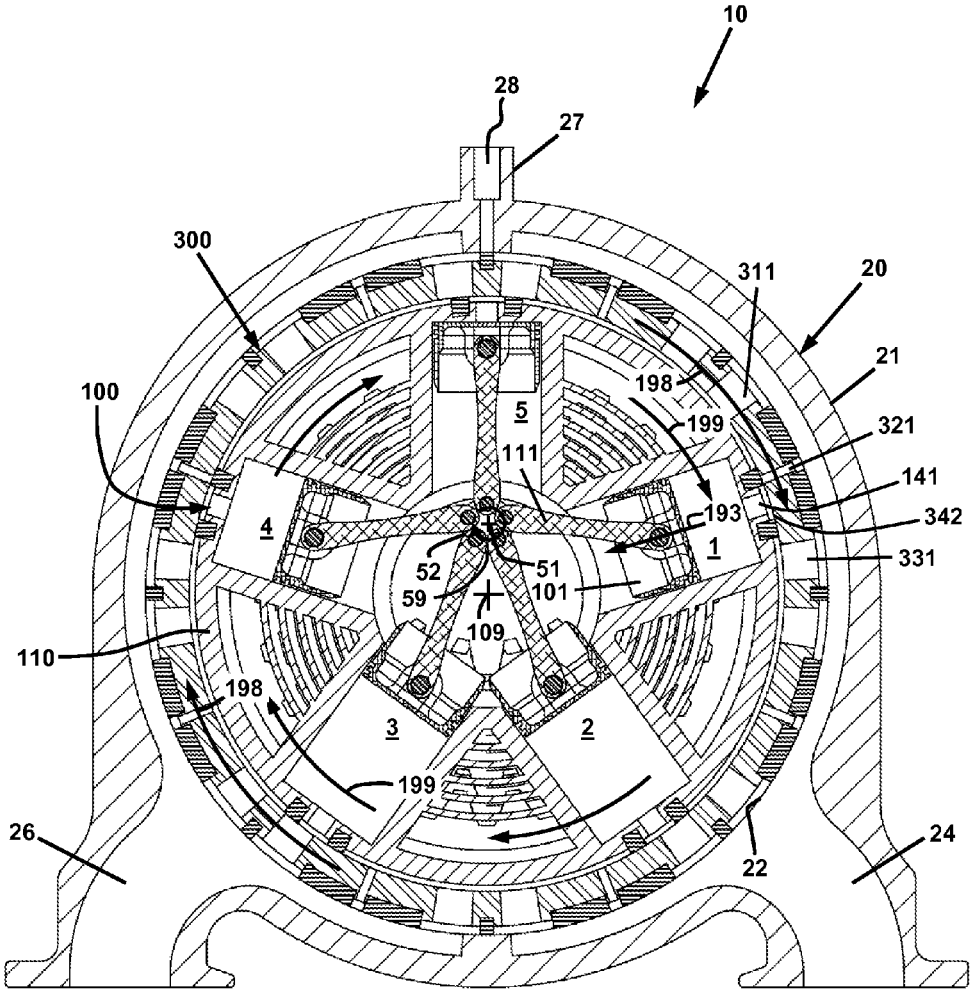
Figure 4H:
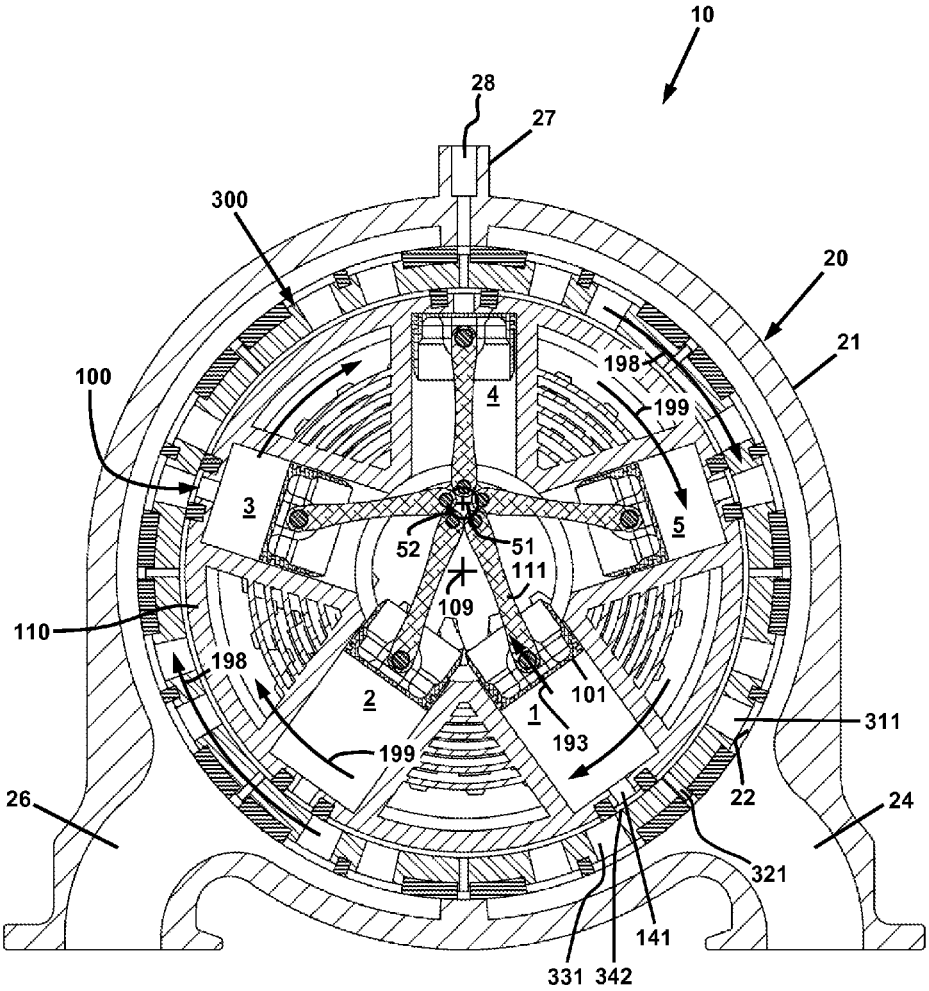

Turning first to FIG. 4G, the middle of the power stroke is depicted. The rotating cylinder assembly 100 has rotated further, and the high pressure of the hot combustion gas within cylinder 1 is forcing the piston 101 downwardly relative to the cylinder as indicated by arrow 193. Connecting rod 111 transmits the force to the crankshaft 50, thus applying a torque thereto and causing crankshaft rotation as indicated by arrow 59. The rotating valve ring 300 has also rotated further, but again through a lesser angle than the rotating cylinder assembly 100. A barrier wall 342 that is located in rotating valve ring 300 between and ignition port 321 and exhaust valve 331 is now blocking cylinder port 141, thereby sealing cylinder 1. As the rotating cylinder assembly 100 continues to rotate, the piston 101 continues its forceful downward motion, as the hot exhaust gas contained therein expands.

It is noted that the location of the connections of the rods 111-115 to the crankshaft 50 may be different than what is depicted in the drawings. For example, each of the rods 111-115 may be connected to the flange 52 of the crankshaft at a location that is further around the crankshaft in the clockwise direction in FIG. 4G. Additionally, the flange 52 may be larger than depicted, so that the "lever arm" action of the rods 111-115 on the crankshaft 50 is increased. In that manner, optimum torque of the rods on the crankshaft is obtained.

Additionally, the Applicant has performed a vector analysis of forces that occur during operation of the internal combustion engine 10. Without wishing to be bound to any particular theory, the Applicant believes that during operation of the engine 10, the reciprocating action of the pistons 101-105 within their respective cylinders provides an additional torque on the rotating cylinder assembly 100, which in turn is applied to the crankshaft 50.

Referring to FIG. 4H, the end of the compression stroke is depicted. The rotating cylinder assembly 100 has rotated further, and piston 101 has nearly ceased its downward motion as indicated by arrow 193 relative to the cylinder. The rotating valve ring 300 has also rotated further, but again through a lesser angle than the rotating cylinder assembly 100. Cylinder port 141 remains blocked by barrier wall 342. With a small further angular displacement of the rotating cylinder assembly 100 and rotating valve ring 300, the piston 101 ceases its downward motion, and the cylinder port 141 approaches the exhaust valve 331. The exhaust stroke ensues.

Summary of Exhaust Stroke:

During the exhaust stroke of the piston from the proximal end of the cylinder to the distal end of the cylinder, the rotating valve ring positions an exhaust port for the respective combustion cylinder so that the combustion chamber of the cylinder is in communication with the exhaust plenum, thereby causing combustion gas contained in the combustion chamber to flow into the exhaust plenum and out of the engine. The exhaust stroke for cylinder 1 is depicted in FIGS. 4I-4K.

Figure 4I:
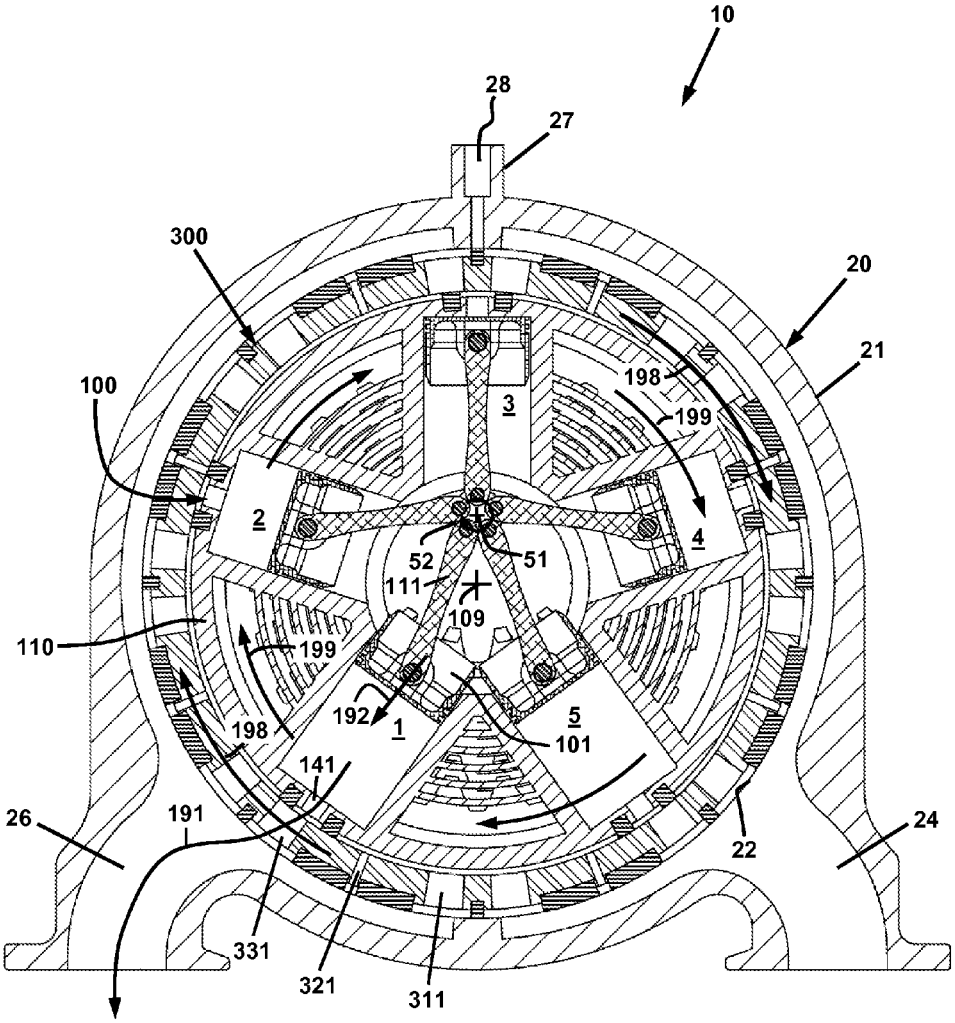

Turning first to FIG. 4I, the beginning of the exhaust stroke is depicted. The rotating cylinder assembly 100 has rotated further, causing the piston 101 to begin its upward motion relative to the cylinder as indicated by arrow 192. The rotating valve ring 300 has also rotated further, but again through a lesser angle than the rotating cylinder assembly 100. Thus the exhaust valve port 331 is beginning to overlap the port 141 of cylinder 1. As a result of the upward motion of the piston 101, hot exhaust gas is caused to flow from cylinder 1 through the cylinder port 141, through the exhaust valve port 331, through the exhaust plenum 24 and out of the engine block 20 as indicated by arrow 191.

Figure 4J:
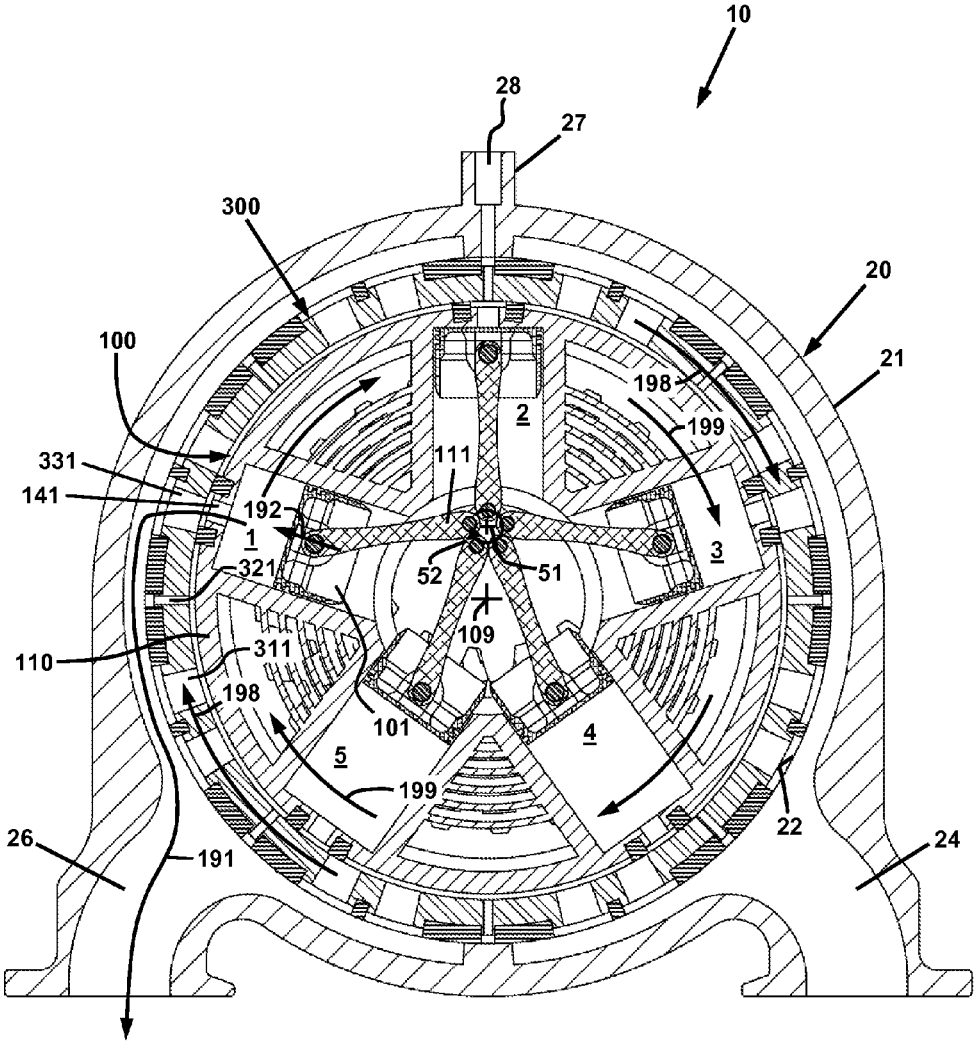

Referring to FIG. 4J, the middle of the exhaust stroke is depicted. The rotating cylinder assembly 100 has rotated further, causing the piston 101 to continue its upward motion relative to the cylinder as indicated by arrow 192. The rotating valve ring 300 has also rotated further, but again through a lesser angle than the rotating cylinder assembly 100. Exhaust valve 331 and cylinder port 141 are now fully aligned, and the hot exhaust gas continues to flow from cylinder 1 through the cylinder port 141, through the valve port 311, through the intake plenum 24 and out of the engine block 20 as indicated by arrow 191.

Figure 4K:
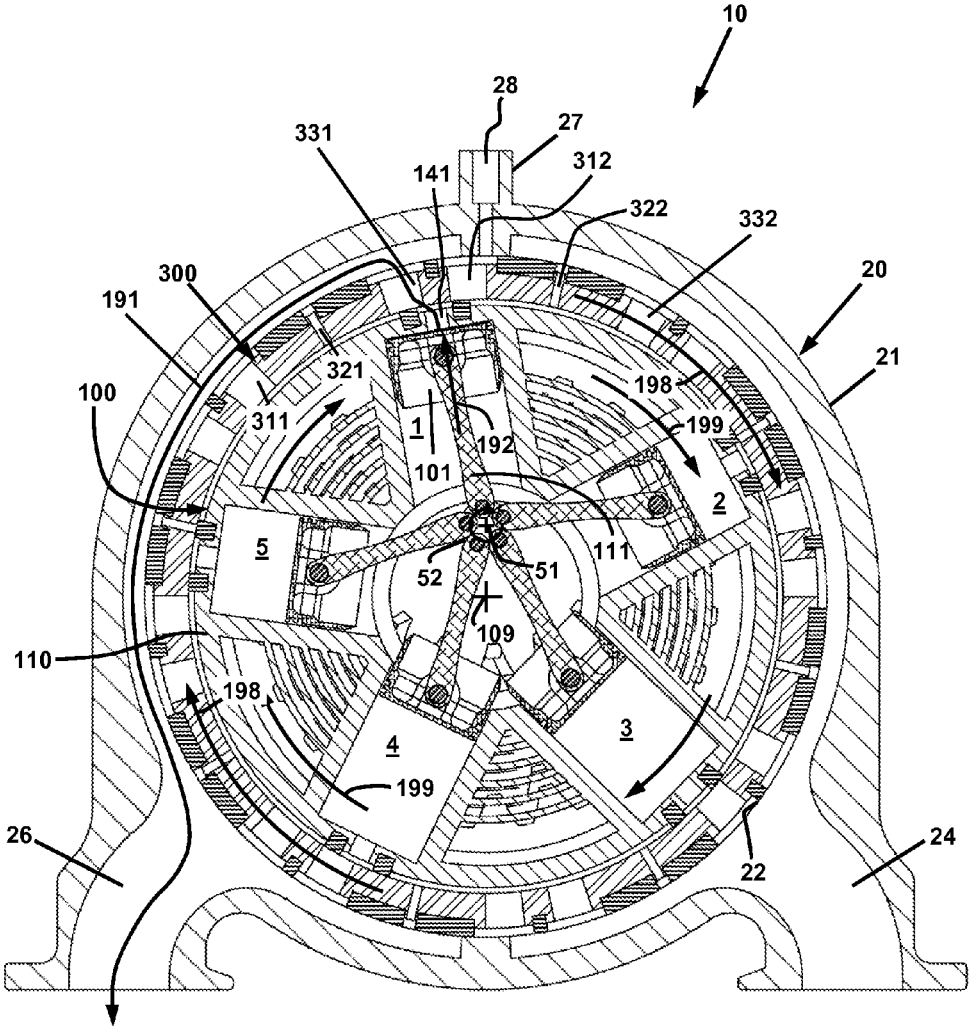

Referring to FIG. 4K, the end of the exhaust stroke is depicted. The rotating cylinder assembly 100 has rotated further, and piston 101 has nearly ceased its upward motion as indicated by arrow 192 relative to the cylinder as cylinder 1 approaches top dead center. The rotating valve ring 300 has also rotated further, but again through a lesser angle than the rotating cylinder assembly 100. Cylinder port 141 has now nearly moved past exhaust valve 331. The flow of exhaust gas from cylinder 1 as indicated by arrow 191 has nearly ceased.

With a small further angular displacement of the rotating cylinder assembly 100 and rotating valve ring 300, the piston 101 ceases its upward motion at top dead center, and is in the position as shown in FIG. 3A. The entire combustion cycle of intake, compression, ignition, power, and exhaust is then repeated. It is noted that on the combustion cycle described above, the port set 301 comprising of intake port 311, ignition port 321, and exhaust port 331 were used to perform the functions of intake, ignition, and exhaust. On the next cycle, the port set 302 comprising of intake port 312, ignition port 322, and exhaust port 332 will be used to perform the functions of intake, ignition, and exhaust. On subsequent combustion cycles, the port sets 303, 304, 305, 306, 307, and 308 (see also FIG. 3B) will be used for intake, ignition, and exhaust. Then the entire cycle will continue to repeat using port sets 301-308 in sequence.

In the embodiment of the engine 10 depicted in FIGS. 2E-4K, the rotating piston assembly 100 is comprised of five cylinders 1-5, and the rotating valve ring is comprised of eight port sets 301-308. Thus, with the engine 10 operating as a four cycle engine, the combustion cycle requires two rotations of the rotating cylinder assembly 100. Concurrently, the rotating valve ring 300 rotates two rotations minus the sector angle occupied by a single set of ports. With there being eight port sets 301-308, a single port set occupies a sector of 45 degrees, or one eighth of the circumference of the rotating valve ring. Hence, during a combustion cycle, while the rotating cylinder assembly 100 rotates two times, the rotating valve ring 300 rotates 1⅞ times. The rotational ratio of the rotating cylinder assembly 100 to the rotating valve ring 300 is thus 16/8: 15/8, or 16:15. The gearing between the rotating cylinder assembly 100 and the rotating valve ring 300 as described previously herein provides this rotational ratio.

It is to be understood that other configurations of the engine 10 are contemplated. Firstly, the engine 10 may be comprised of more or less than five cylinders 1-5. Secondly, other port configurations for the rotating valve ring 300 are possible. The rotating valve ring 300 may have more or fewer port sets, so long as the proper gearing is provided so as to align an intake port with a cylinder port during the intake stroke, and to align an ignition port with the cylinder port during delivery of ignition energy, and to align an exhaust port with the cylinder port during the exhaust stroke. The gearing between the rotating cylinder assembly 100 and the rotating valve ring 300 as described previously herein is thus adjusted accordingly to provide the required rotational ratio to accomplish the desired alignment of the ports during intake, ignition, and exhaust.

Additionally, it is not required that the rotating cylinder assembly 100 rotates at a higher speed than the rotating valve ring 300. In other embodiments, the rotating cylinder assembly 100 may rotate at a lower speed than the rotating valve ring 300. In such a configuration, the order of porting of the rotating valve ring simply needs to be reversed, i.e., the porting order is exhaust-ignition-intake, rather than intake-ignition-exhaust as shown in FIG. 3B. In that manner, the desired port alignments during intake, ignition, and exhaust is provided. Again, the gearing between the rotating cylinder assembly 100 and the rotating valve ring 300 as described previously herein is adjusted accordingly to provide the required rotational ratio to accomplish the desired alignment of the ports during intake, ignition, and exhaust.

The respective materials of construction of the engine block 20, the cylinder housing 110, the pistons 101-105, the piston rods 111-115, the crankshaft 50, and the rotating valve ring 300 may be the same as used for analogous parts in conventional internal combustion engines. Such materials may include but are not limited to cast iron, aluminum alloys, steel alloys, and ceramics, with the operative requirements for any particular material including sufficient structural strength, resistance to heat generated by combustion of fuel within the cylinders, and resistance to chemical degradation by the fuel and by the hot exhaust gases.

In certain embodiments, the number of sets of valve port sets S may be defined by the relationship:

$$S=(1.5\times C)+0.5$$

where C is equal to any odd number of combustion cylinders.

Additionally, the ratio R of the number of rotations of the rotating cylinder assembly 100 to the number of rotations of the rotating valve ring 300 may be defined by the relationship:

$$R=1+1/(3C).$$

It can be seen that for the exemplary internal combustion engine depicted in the drawings and described herein, the above equations apply. The exemplary engine has five cylinders. Thus S=16/15, and R=8 port sets as described previously.

The rotating cylinder assembly 100 and rotating valve ring 300 may be provided with seals to contain the combustible intake mixture and the combustion gases within the desired locations of the engine 10 during the combustion cycle. Referring again to FIG. 2E, each of the cylinder ports are provided with a seal or seals to prevent gas leakage between the rotating cylinder housing 110 and the inner surface 350 of the rotating valve ring 300. For example, cylinder port 141 may be provided with seals 151 and 152 that are disposed in machined grooves in the external surface 117 of the rotating cylinder housing 110. In alternative embodiment (not shown), an O-ring seal that surrounds cylinder port 141 may be provided. In like manner, the various valve ports of the rotating valve ring 300 may also be provided with seals 351 fitted to grooves formed in the outer surface 352 thereof, or with seals that surround each of the respective ports in the rotating valve ring 300.

The various seals are made of materials such as, e.g., a fluoropolymer or a ceramic, that are suitably resistant to heat and chemical degradation by the combustion fuel and the hot exhaust gases.

It is, therefore, apparent that there has been provided, in accordance with the present invention, an internal combustion engine. Having thus described the basic concept of the invention, it will be rather apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims.

I claim:

1. An internal combustion engine comprising:

a) an engine block comprised of a main cavity, an intake plenum, and an exhaust plenum;

b) a crankshaft supported within the main cavity of the engine block and having a crankshaft axis of rotation;

c) a rotating piston assembly contained within the main cavity of the engine block and comprised of a rotatable cylinder housing having a housing axis of rotation and comprised of a plurality of pistons contained in combustion cylinders, the cylinder housing axis of rotation parallel to and offset from the crankshaft axis of rotation, each of the plurality of combustion cylinders comprising a cylindrical side wall and a top wall formed in the cylinder housing, and each piston operatively connected by a piston rod to the crankshaft and reciprocable along the central axis of the cylindrical side wall, wherein for each of the plurality of pistons in combustion cylinders, the piston and the cylindrical side wall and top wall of the cylinder form a variable volume combustion chamber;

d) a rotating valve ring contained within the engine block and surrounding the rotating piston assembly, the rotating valve ring comprised of valve port sets, each valve port set comprising intake ports, ignition energy ports, and exhaust ports communicable with each of the plurality of combustion cylinders;

wherein:

the rotating piston assembly and the rotating valve ring are operatively coupled to the crankshaft such that the rotating piston assembly and the rotating valve ring rotate synchronously with rotation of the crankshaft;

rotation of the piston assembly around the rotatable cylinder housing axis of rotation causes the distance from the crankshaft to the cylindrical side wall of each combustion cylinder to vary periodically, thereby causing each piston to reciprocate within its cylindrical side wall in repeated intake, compression, power, and exhaust strokes;

for each respective combustion cylinder, during the intake stroke of the piston contained therein from a distal end of the cylinder to the proximal end of the cylinder, the rotating valve ring positions an intake port for the respective combustion cylinder so that the combustion chamber of the cylinder is in communication with the intake plenum, thereby causing a gas contained in the intake plenum to flow into the combustion chamber;

and during the compression stroke of the piston from the proximal end of the cylinder to the distal end of the cylinder, the rotating valve ring positions a first barrier wall that seals the top wall of the combustion cylinder, thereby causing compression of the gas in the combustion chamber as the piston moves from the proximal end of the cylinder to the distal end of the cylinder;

and at substantially the end of the compression stroke of the piston, the rotating valve ring positions an ignition energy port in communication with the combustion chamber and an ignition energy source, thereby delivering ignition energy to the gas, thereby causing the gas in the combustion chamber to ignite;

and during the power stroke of the piston from a distal end of the cylinder to the proximal end of the cylinder, the gas combusts while the rotating valve ring positions a second barrier wall that seals the top wall of the combustion cylinder, thereby causing an increase in pressure within the combustion chamber, thereby applying a force on the piston and the connecting rod in the proximal direction, and thereby applying a torque on the crankshaft to cause crankshaft rotation;

and during the exhaust stroke of the piston from the proximal end of the cylinder to the distal end of the cylinder, the rotating valve ring positions an exhaust port for the respective combustion cylinder so that the combustion chamber of the cylinder is in communication with the exhaust plenum, thereby causing combustion gas contained in the combustion chamber to flow into the exhaust plenum.

2. The internal combustion engine of claim 1, wherein the number of combustion cylinders is an odd number.

3. The internal combustion engine of claim 2, wherein the number of valve ports is S, and is defined by the relationship $S=(1.5\times C)+0.5$, where C is the number of combustion cylinders.

4. The internal combustion engine of claim 2, wherein in the synchronous rotation of the rotating piston assembly and the rotating valve ring, the ratio of the number of rotations of the rotating piston assembly to the number of rotations of the rotating valve ring is R and is defined by the relationship $R=1+1/(3C)$, where C is the number of combustion cylinders.

5. The internal combustion engine of claim 1, wherein the engine block includes a single ignition source port that is communicable with each of the ignition energy ports of the valve port sets.

6. The internal combustion engine of claim 1, wherein during the intake stroke, the gas contained in the intake plenum that is caused to flow into the combustion chamber is a combustible gas.

7. The internal combustion engine of claim 1, wherein the rotational speed of the rotating valve ring is greater than the rotating speed of the rotating piston assembly.

8. The internal combustion engine of claim 1, wherein the rotational speed of the rotating valve ring is less than the rotating speed of the rotating piston assembly.

* * * * *